US007320557B1

(12) United States Patent
Potter

(10) Patent No.: US 7,320,557 B1
(45) Date of Patent: Jan. 22, 2008

(54) ANTI-TERRORISM VEHICLE SECURITY BARRIER

(75) Inventor: Thomas E. Potter, Hummelstown, PA (US)

(73) Assignee: PRO Barrier Engineering, LLC, Hummelstown, PA (US)

( * ) Notice: Subject to any disclaimer, the term of this patent is extended or adjusted under 35 U.S.C. 154(b) by 276 days.

(21) Appl. No.: 11/235,919

(22) Filed: Sep. 27, 2005

Related U.S. Application Data

(60) Provisional application No. 60/616,169, filed on Oct. 5, 2004.

(51) Int. Cl.
*E01F 13/00* (2006.01)

(52) U.S. Cl. ..... 404/6; 49/49; 49/131

(58) Field of Classification Search ..... 49/9, 49/33, 34, 49, 131; 404/6; 256/13.1
See application file for complete search history.

(56) References Cited

U.S. PATENT DOCUMENTS 1,628,651 A * 5/1927 Burress ..... 49/9
2,336,483 A * 12/1943 Hoover ..... 49/9
3,024,549 A * 3/1962 Lubmann ..... 49/131
3,925,929 A * 12/1975 Montgomery ..... 49/35
3,956,853 A * 5/1976 Montgomery ..... 49/35
4,989,835 A * 2/1991 Hirsh ..... 256/13.1
5,245,787 A * 9/1993 Swenson et al. ..... 49/34
5,248,215 A * 9/1993 Fladung ..... 404/6
6,062,765 A * 5/2000 Dotson ..... 404/6

* cited by examiner

*Primary Examiner*—Gary S Hartmann
(74) *Attorney, Agent, or Firm*—Miller Law Group, PLLC

(57) ABSTRACT

A vehicle barrier is formed with a barrier gate mounted on a pair of opposing lift arms pivotally connected via pivot shafts to a support structure. A plurality of endless bands are looped around the opposing pivot shafts and positioned to pass through compartments in the barrier gate. The lift arms and the barrier gate may be fabricated from lightweight material, such as thin steel, aluminum or plastic, so that the stopping power of the vehicle barrier is provided by the anchored bands. In permanent or portable configurations, the lightweight barrier gate can be quickly raised by hydraulic cylinders, or other appropriate means, into a deployed position to interfere with the passage of a vehicle over the barrier. The anchoring of the bands at ground or below ground locations on both sides of the barrier provides stopping power without requiring massive barrier structures to be raised and lowered in use.

20 Claims, 19 Drawing Sheets

ANTI-TERRORISM VEHICLE SECURITY BARRIER

CROSS-REFERENCE TO RELATED APPLICATIONS

This application claims domestic priority on U.S. Provisional Patent Application Ser. No. 60/616,169, filed on Oct. 5, 2004, the contents of which are incorporated herein by reference.

BACKGROUND OF THE INVENTION

The present invention relates generally to devices for preventing vehicles from passing beyond a predetermined point in a roadway to provide security control and, more particularly, to a roadway barrier that can be selectively actuated to restrict access over a roadway The present invention also relates to an apparatus for transporting multiple portable crash barriers and, more particularly, to a transporter mechanism for positioning portable crash barriers after delivery thereof to a deployment location.

For many years, a small number of companies have sold vehicle crash barriers primarily designed to thwart deliberate vehicle-based attacks of buildings. These barriers are generally heavy steel structures imbedded in concrete or concrete structures in a road surface that physically obstruct the roadway. These heavy steel structure devices are designed so that a barrier device (usually a steel plate) can be raised or lowered to control the ability of a vehicle to pass through or over the barrier and, thus, gain access to the building being secured. These devices differ from the barriers commonly encountered in parking garages and other public venues, in that they have very high stopping power, for example, preventing a 15,000-pound explosive laden truck traveling at 50 mph from passing beyond the vehicle barrier.

Barriers come in numerous designs, but they can generally be categorized in three conventional types: plate, beam, and bollard. The plate barrier can be oriented to lay relatively flat on the surface of the roadway and be selectively actuated to be angled upwardly upon a perceived threat to form a wedge that restricts passage of a vehicle. The plate barrier is considered to be a permanently installed device as the plate is supported on a concrete encased frame that is buried into the surface of the roadway. A variation of the plate barrier has been introduced recently into the marketplace as a portable barrier. Another variation is to fasten the plate barrier to the roadway, such as with bolts. This barrier device is essentially a plate type barrier that is not imbedded in concrete, but instead can be moved to different locations to accommodate the need for temporary or changing security needs. Since the portable plate barrier is not imbedded in concrete, stopping power is relatively limited.

The beam barrier incorporates a vertically movable beam that is typically pivotally supported at one end of the beam by a steel support that is imbedded in concrete to provide a relatively immovable object and at the opposing end by a similar steel support at the opposing side of the roadway. The beam barrier serves as a movable gate that can be raised vertically (or swung horizontally) to allow vehicles to pass or lowered into engagement with the steel supports at either end of the beam to provide a substantial resistance to the passage of any vehicle. As with the conventional plate barrier, the beam barrier provides a permanent installation and relatively high stopping power. Some beam barriers use bands of nylon or similar material that are contained within the hollow beam and wrapped around the pivot structure for the beam to increase the resistance of the steel beam.

The bollards are typically permanently installed steel or concrete barriers that are typically not selectively movable, although vertical movement could be provided to permit the structure to rise into a passage restrictive position above the surface of the roadway, or be retracted into the ground to permit the passage of vehicles. Generally, bollards are a permanent structure that cannot be made portable without loss of substantial stopping power capabilities.

Historically, vehicle barriers achieved their effectiveness by their mass and by the fact that they were permanently anchored in concrete. The vehicle barrier produced by Nasatka Barrier, Inc. is a beam-type of barrier that utilizes bands in the drop arm (beam) that are utilized to help stop the passage of vehicles. This barrier uses heavy-duty commercial straps or bands (usually nylon) of the kind used to lift large static loads in other commercial applications. While the bands are very strong and have a high stopping power, this beam-type barrier utilizes massive structures to engage each end of the movable beam to resist the impact of the oncoming vehicle. The bands are used to reinforce the drop arm and are anchored at the pivot end of the drop arm.

Conventional barriers have another disadvantage inherent in their designs in that each barrier design requires active mechanical movement of very heavy structures. Heavy steel plates (plate barriers) or heavy cylinders (bollard barriers) have to be raised against gravity in order to stop vehicles. Current vehicle barriers require approximately two seconds for emergency activation from an open position in which the vehicle can pass by the barrier to a deployed position in which a vehicle is prevented from passing by or over the barrier. Activation times for conventional beam barriers and sliding gate barriers are even longer, averaging about ten seconds for barriers that are one traffic lane wide and substantially longer for larger two lane barriers.

A vehicle traveling 50 mph covers 73 feet per second. Even if the barrier activation time is only two seconds, the facility needs to have almost 150 feet of standoff distance between the barrier close signal, such as from a guard or automated system, and the physical location of the barrier itself. Many facilities simply do not have the necessary space to accommodate this type of operation. This means that many existing barriers are seldom used in an "activate only when needed" mode. Thus, the barrier is always up and must be lowered for every authorized vehicle.

In addition, this constant raising and lowering of the vehicle barrier to allow authorized vehicle passage, over the course of its operating lifetime, requires a vehicle barrier to be cycled open and closed hundreds of thousands or even millions of times. Requiring constant movement from highly massive structures presents substantial challenges with respect to the maintenance and repair of vehicle barriers. Simply reducing the weight of the vehicle barrier is not a satisfactory resolution to these maintenance challenges as the stopping power of the vehicle barrier must be maintained.

It would be desirable to provide an improved vehicle crash barrier that would provide a lower cost, yet highly effective barrier for security purposes which could be made into a portable or permanent version. For portable barriers, the ability to transport the barriers from one location to another is restricted and it would be desirable to provide a transporter that could be used to move and locate multiple portable vehicle barriers quickly and conveniently.

SUMMARY OF THE INVENTION

It is an object of this invention to provide a vehicle barrier that has high stopping power without requiring a large mass.

It is another object of this invention to provide a vehicle barrier that can be manufactured in either a permanent installation form or in a portable configuration.

It is still another object of this invention to provide a transport carrier that is operable to transport multiple portable vehicle barriers simultaneously.

It is a feature of this invention that the structural parts of the barrier that would be engaged by a vehicle are fabricated from lightweight materials.

It is an advantage of this invention that the weight of the barrier structure being moved is reduced compared to conventional vehicle barriers.

It is another feature of this invention that the cycle time to move the vehicle barrier from a lowered, open position to a raised deployed position is reduced in comparison with conventional vehicle barriers.

It is yet another object of this invention that the stopping power of the vehicle barrier is provided by bands that extend through the barrier gate and encircle the pivot supports for the raised arm to which the barrier is attached.

It is still another feature of this invention that the bands are formed in continuous loops that are captured by the pivot shaft on opposing sides of the vehicle barrier.

It is still another object of this invention to provide a vehicle barrier of a standardized construction that can provide selectively variable stopping power.

It is yet another feature of this invention that the stopping power of the vehicle barrier can be varied by changing the number of bands mounted within the lift arms and barrier gate.

It is still another feature of this invention that the pivot shafts are located near or below the roadway surface which eliminates the for massive above-ground support structure.

It is still another advantage of this invention that the frame supporting the pivot shafts will not be significantly damaged by a vehicle impact and, thus, the barrier can be re-constituted without excavation of the frame by replacing only the beam, side arms, bands, pivot shafts and actuating mechanisms, thereby substantially lowering the cost and time to replace the barrier.

It is another advantage of this invention that the vehicle barrier can be manufactured in a permanent configuration in which the pivot shafts for the lift arms are supported in massive frames to prevent the pivot shafts from being pulled from their respective mounting when the barrier is impacted by a vehicle.

It is another feature of this invention that the bands are routed through multiple compartments within the barrier gate.

It is still another advantage of this invention that the portable configuration of the vehicle barrier has the pivot shafts for the lift arms mounted in reinforced steel mounting structures to prevent the pivot shafts from being released from the barrier.

It is yet another feature of this invention that the transporter for the portable barrier configuration is capable of transporting multiple portable vehicle barriers simultaneously.

It is yet another advantage of this invention that the portable vehicle barriers are transported in an endwise orientation to minimize transport width.

It is yet another object of this invention to provide a transporter for portable vehicle barriers that can rotate the transported portable vehicle barriers into a transversely oriented position for deployment onto the roadway at the desired location.

It is still another feature of this invention that the transporter uses a cable lift mechanism to raise the portable vehicle barriers into an elevated position within the transporter where the portable barrier is supported on pivotal dogs.

It is still another advantage of this invention that the transporter can place the portable vehicle barrier in the desired deployed position without requiring additional movement of the barrier for deployment.

It is yet another object of this invention to provide a vehicle barrier that is which is durable in construction, inexpensive of manufacture, carefree of maintenance, facile in assemblage, and simple and effective in use.

It is a further object of this invention to provide a transporter for portable vehicle barriers that is which is durable in construction, inexpensive of manufacture, carefree of maintenance, facile in assemblage, and simple and effective in use.

These and other objects, features and advantages are accomplished according to the instant invention by providing a vehicle barrier that is formed with a barrier gate mounted on a pair of opposing lift arms pivotally connected via pivot shafts to a support structure. A plurality of endless bands are looped around the opposing pivot shafts and positioned to pass through compartments in the barrier gate. The lift arms and the barrier gate may be fabricated from lightweight material, such as thin steel, aluminum or plastic, so that the stopping power of the vehicle barrier is provided by the anchored bands. In permanent or portable configurations, the lightweight barrier gate can be quickly raised by hydraulic cylinders, or other appropriate means, into a deployed position to interfere with the passage of a vehicle over the barrier. The anchoring of the bands at ground or below ground locations on both sides of the barrier provides stopping power without requiring massive barrier structures to be raised and lowered in use.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 19:
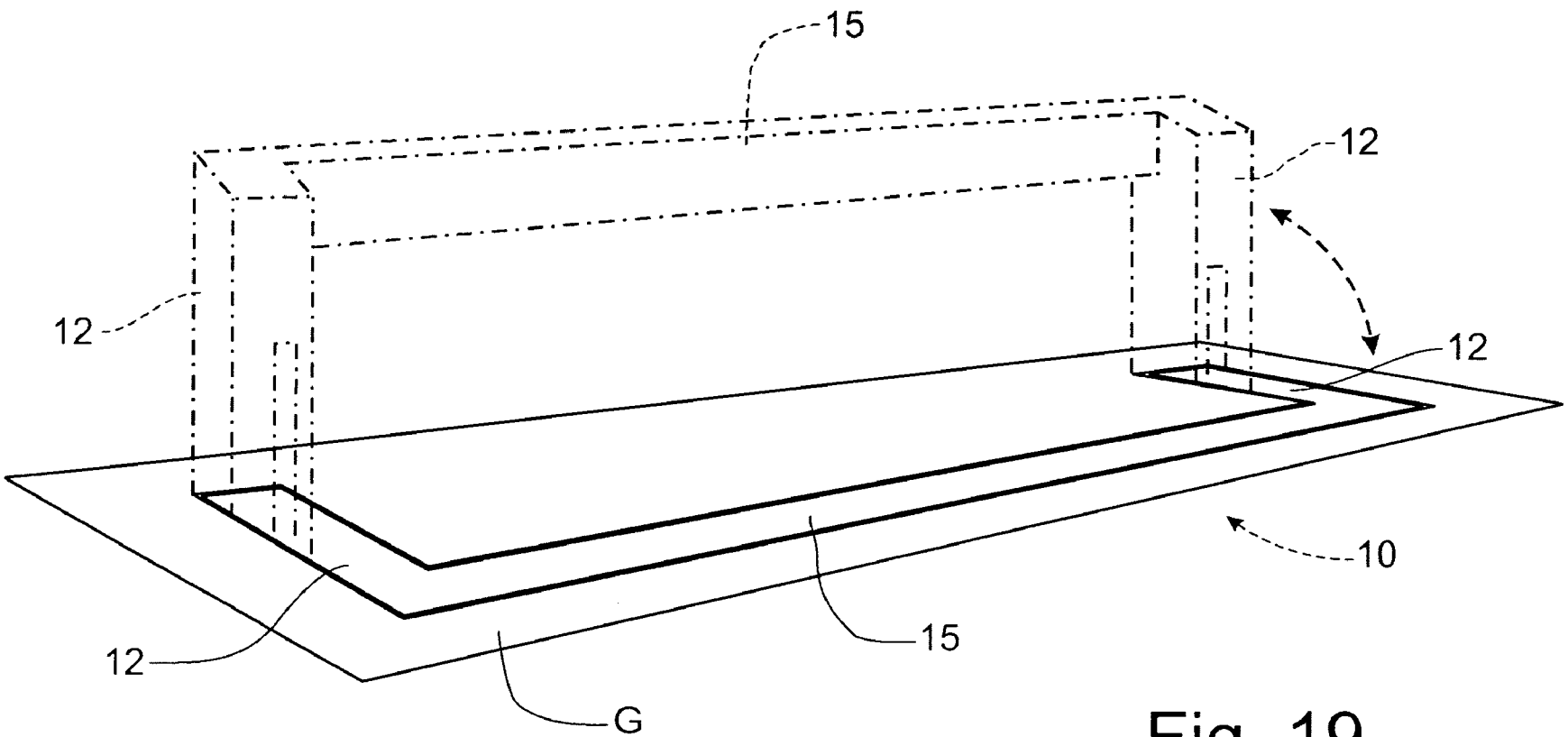
FIG. 19 is a schematic perspective view of the vehicle security barrier corresponding to the embodiment depicted in FIGS. 1-5 and embedded into the ground, the vehicle security barrier being retracted into the ground in the lowered position that allows vehicles to pass over the barrier, the movement of the barrier into the raised deployed position being shown in phantom and being depicted by an arrow.

Referring now to FIGS. 1-5 and 19-21, a vehicle security barrier incorporating the principles of the instant invention can best be seen. The configuration of the barrier 10 depicted in FIGS. 1-5 is a permanent installation, as opposed to the portable version depicted in FIGS. 6-12 and described in greater detail below. The installation of a permanent vehicle security barrier 10 requires an excavation of the road surface to install the components below the finished grade of the road surface G so that the back side of the barrier beam 15 is oriented substantially flush with the road surface G, as is depicted in FIG. 19 so as to not interfere with the passage of a vehicle when the barrier is in a lowered or open orientation.

The barrier 10 is formed with transversely opposing pivot arms 12 that are pivotally mounted for vertical movement about a horizontal, transversely disposed pivot shaft 13. Movement of the pivot arms 12 is accomplished by hydraulic cylinders 14 anchored to permanent support structure 11 formed in the excavated portion of the roadway, below finished grade G. Similarly, the pivot shafts 13 are rotatably supported by mounting members 45 that are attached to and supported by the permanent support structure 11. Spanning between the opposing pivot arms 12 is a hollow barrier beam 15 that becomes movable with the pivot arms 12 between a lowered or open position depicted in FIG. 1 and a raised operative position depicted in FIG. 4. When in the raised operative position, or deployed position, the barrier beam 15 presents an obstacle to the passage of a vehicle past the barrier 10.

The barrier 10 is also formed with a plurality of reinforcing bands 17 that are anchored on the pivot shaft 13 at one pivot arm 12, and then pass through the hollow barrier beam 15 to be anchored on the pivot shaft 13 at the opposing pivot arm 12. These reinforcing bands 17 are preferably formed of nylon, or other appropriate material, such as are used commercially as lifting straps for cranes, etc. These reinforcing bands 17 are capable of individually withstanding considerable force, but when coupled with other reinforcing bands running through the barrier beam 15 from one anchor point to the other, the stopping power becomes very high.

Preferably, the supporting structure 11 is embedded in concrete in a permanent installation beneath the surface of the road. The supporting structure 11 can include the transversely extending I-beams 41, 42 which provide structural strength in the supporting structure 11 against which the pivot shaft 13 anchored. Additional beams 43, 44 extending longitudinally and transversely further strengthen the supporting structure 11. A pipe 49 can be placed in the support structure to provide access into the hydraulic cylinder 14 for hydraulic hoses and to serve as a drain.

The pivot shafts 13 are preferably mounted in reinforced hubs 45 that are welded to the supporting structure 11. Appropriately placed bushings or bearings (not shown) can be utilized to facilitate the pivotal movement of the pivot shafts 13 relative to the mounting members 45. One skilled in the art will recognize that the bushings or bearings (not shown) can be located between the pivot arm 12 and the pivot shaft 13 so that the pivot shaft 13 remains stationary as the pivot arm rotates relative to the pivot shaft 13; however, such an arrangement would result in the reinforcing bands 17 rotating with the pivot arms 12 about the pivot shafts 13. Preferably, the bushings or bearings would be located between pivot shaft 13 and the reinforced hubs 45, in which case the pivot shafts 13 would rotate with the pivot arms 12 and there would be no relative movement between the pivot shafts 13 and the reinforcing bands 17. The pivot shafts 13 are located in a cavity 46 formed within the supporting structure 11 and covered by a removable lid 47 that permits selective access to the pivot shaft 13 for servicing, repairing or replacing the shaft 13. The cavity 46 also provides the ability to assemble the pivot shaft 13 into the reinforcing hub 45 and the pivot arm 12.

The reinforcing bands 17 are assembled into the security barrier 10 by placing the first end loop of the reinforcing band 17 around the first pivot shaft 13 and then extending the reinforcing band 17 longitudinally along the interior of the pivot arm 12. When aligned with one of the channels 15*a*, 15*b*, 15*c*, in the barrier beam 15, the reinforcing band 17 is folded into a right angle fold 18 and directed through the aligned channel 15*a-c* to the opposing pivot arm 12. The reinforcing bands 17 are then folded into a second right angle fold 18 and directed longitudinally through the interior of the opposing pivot arm 12 to be looped around the other pivot shaft 13. This process is repeated until the desired number of reinforcing bands 17 have been mounted on the pivot shafts 13 and the reinforcing bands are, preferably, equally distributed through the three channels 15*a-c* in the barrier beam 15. The barrier 10 is then completed by capping the pivot arms 12 and the barrier beam 15. The reinforcing bands 17 are preferably layered with the interior most reinforcing bands 17 passing through the most distant channel 15*a* and the most exterior reinforcing bands 17 on the pivot shafts 13 passing through the closest channel 15*c*. Each reinforcing band 17 is sized for its particular application and location on the pivot shaft.

By placing the anchor points for the reinforcing bands 17 at a low, i.e. in the ground and beneath the road surface, position, and taking advantage of the ability to support the anchors on the permanent support structure 11 for the barrier 10, substantial benefits are achieved. By utilizing the reinforcing bands 17 to resist the impact of a vehicle, the beam structure surrounding the reinforcing bands 17 can be made out of lightweight material since the beam structure has little additive value to the stopping power of the reinforcing bands 17. Thus, the vehicle security structure that moves from the open position to the deployed position can be made from light materials and can be actuated more quickly.

Figure 20:
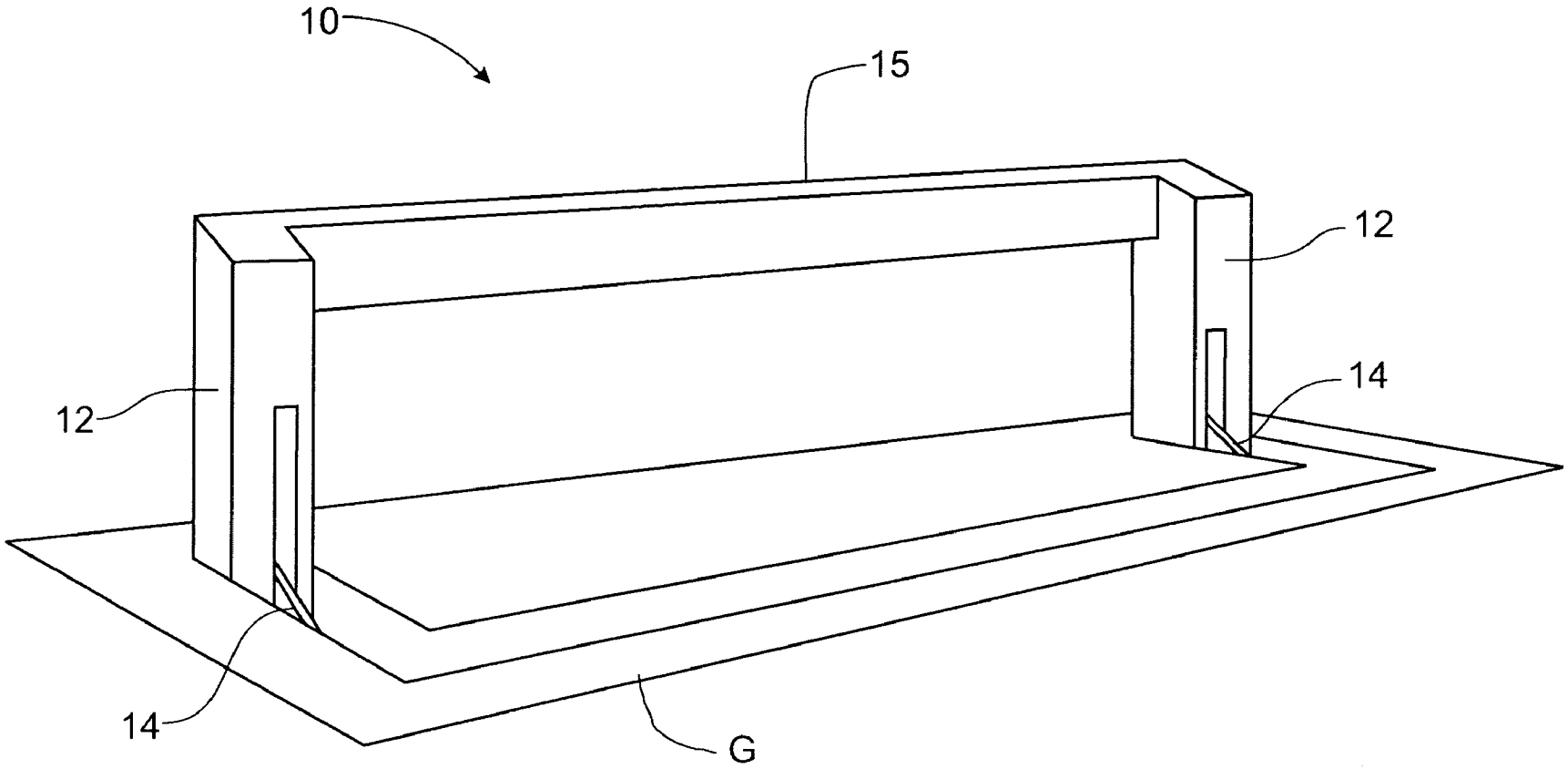
FIG. 20 is a schematic perspective view of the vehicle security barrier shown in FIG. 19, but depicting the barrier moved into the raised deployed position.
Figure 21:
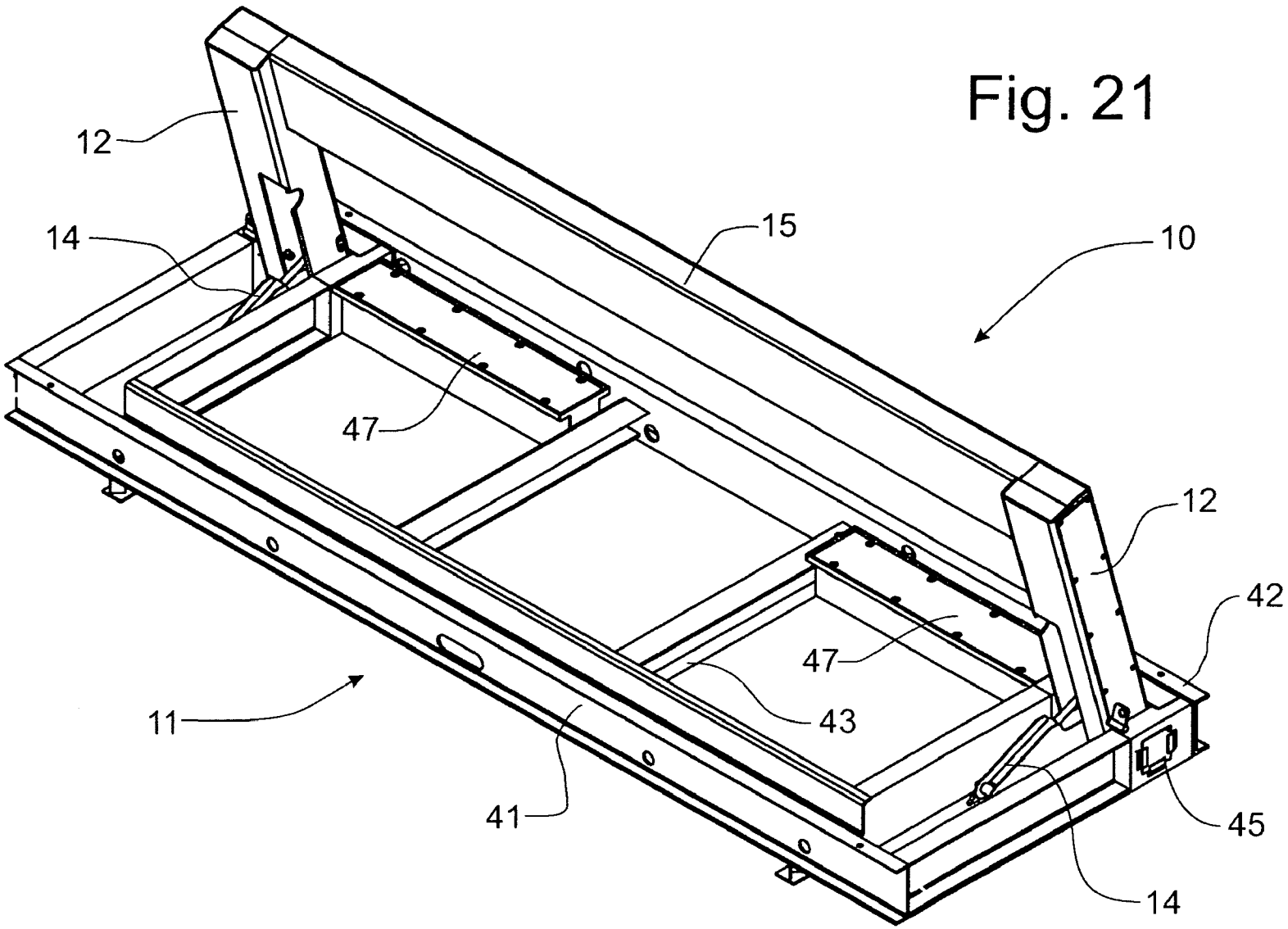
FIG. 21 is a perspective view of the vehicle security barrier corresponding to FIGS. 1-5, but with the barrier and supporting structure being shown as constructed prior to being installed into the ground, the barrier being raised toward the deployed position.

As can be seen best in FIGS. 19-21, the assembled vehicle security barrier 10, as shown in FIGS. 1-5, can be installed into the surface of the ground G such that the pivot arms 12 and the transverse barrier beam 15 are recessed into the ground G to be flat with the surface of the roadway to permit vehicles to pass over the barrier without difficulty. Upon actuation, the hydraulic cylinders 14 are extended to pivot the pivot arms 12 and the barrier beam 15 out of the roadway above the surface of the ground G to impede the passage of vehicles. Preferably, this in-ground version of the vehicle security barrier 10, because of the need for high stopping power, is installed with the frame 11 embedded in concrete with the pivot arms 12 and barrier beam 15 free to move between the lowered position and the raised deployed position.

Another substantial feature of instant invention is the ability to tailor the vehicle stopping power by changing the number of bands or by changing the ply rating of the bands. One skilled in the art will also recognize that varying the width of the reinforcing bands 17 will also change vehicle stopping power. Commercial lifting bands are typically available as 1-, 2-, 3-, or 4-ply, with the ultimate breaking strength increasing with the number of plies. Since all of the bands come to two common anchor points, it is easy adjust the barrier's stopping power by using differing numbers of bands and ply ratings. In the instant invention, essentially all of the stopping power of the barrier 10 arises from the reinforcing bands 17 and the anchor points, as will be described in greater detail below. Unlike other conventional barrier designs, massive and strong plates, beams, or bollards are not required. Accordingly, the pivot arms 12 and the barrier beam 15 holding the bands 17 can be made of lightweight and inexpensive material such as thin steel, aluminum or plastic. The only function of the pivot arms 12 and the barrier beam 15 is to contain the bands 17 and they play no significant role in stopping an impacting vehicle. If the lightweight pivot arm 12, for example, is bent, broken, damaged or destroyed during vehicle impact, the stopping power of the barrier 10 is not degraded.

Because this barrier 10 does not require large, massive above-ground support structures, as is known in the art, the barrier 10 has a very low profile when the pivot arms 12 are lowered. As a direct result, the barrier 10 can disappear substantially completely below the ground in the permanently installed configuration and yet be formed into a portable configuration, as is depicted in FIGS. 6-12. The general construction of the portable vehicle security barrier 20 is very similar to that described above with respect to the permanent configuration. The mounting members 23 are affixed to a support plate 22 that rests on the surface of the road. Since the portable barrier 20 is not placed into a below grade excavation into the roadway G, the low profile barrier beam 15 forms a slight rise over which the vehicle must pass to clear the barrier 20. Accordingly, the barrier beam 15 is preferably formed in a trapezoidal shape with the sloped side members forming a ramp to facilitate the passage of the vehicle when the barrier beam 15 is lowered to the surface of the roadway G.

The hydraulic cylinders 14 are also anchored on the support plate 22 and can be powered by a central power source or powered from an onboard hydraulic system (not shown) that is mounted on the support plate 22 for transport with the barrier 20. Since the transversely spaced hydraulic cylinders 14 are operably interconnected, accommodation for the hydraulic lines interconnecting the two cylinders 14 has to be made. Accordingly, a convex or trapezoidal hose cover 29 is also mounted on top of the support plate 22 to protect the hydraulic lines from damage during passage of a vehicle.

Figure 1:
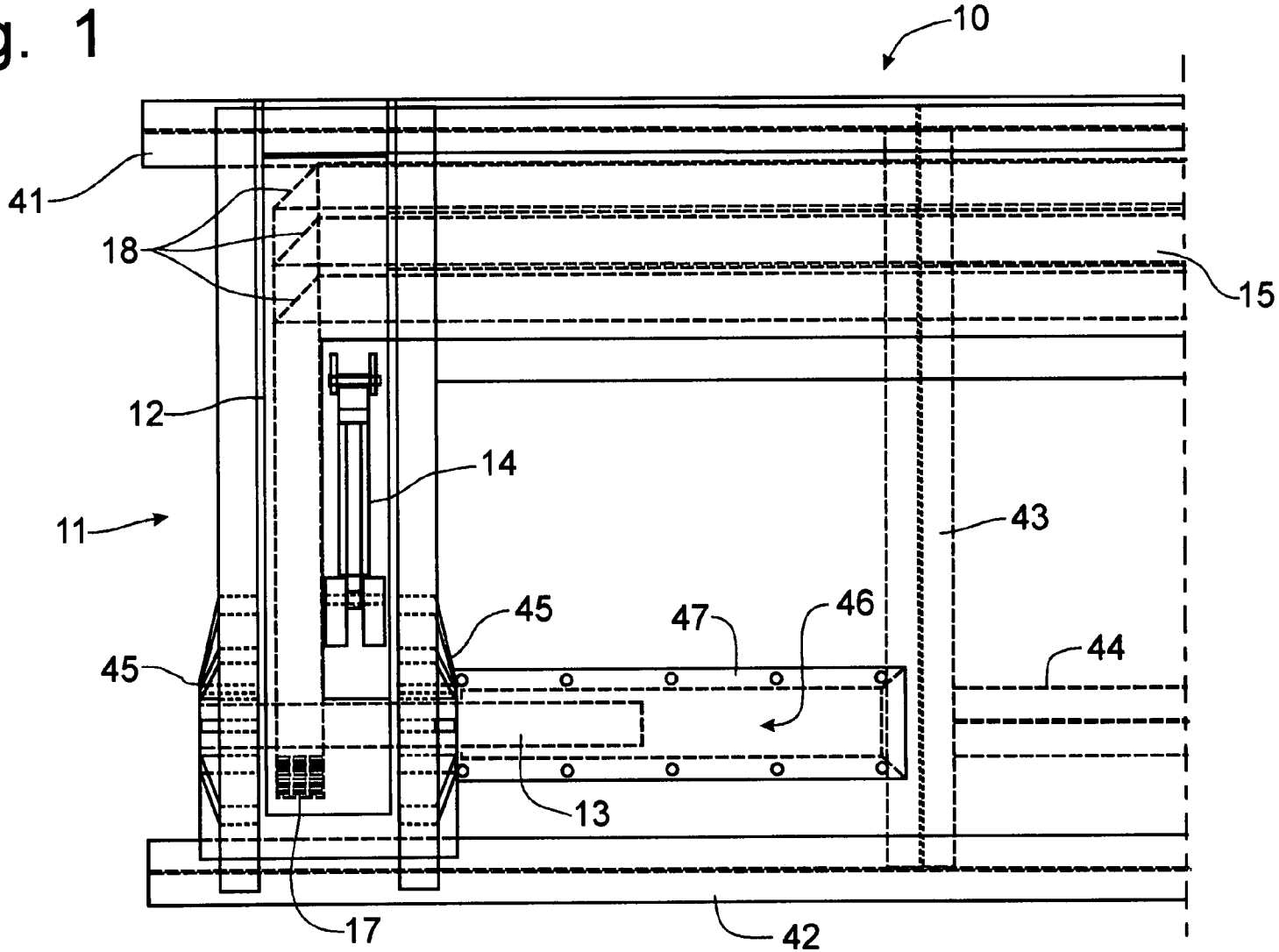
FIG. 1 is a top plan view of a vehicle security barrier incorporating the principles of the instant invention, the barrier being a permanently installed configuration depicted in a lowered or open position, only one half of the vehicle security barrier is shown in the drawing the opposing side being a mirror image.
Figure 2:
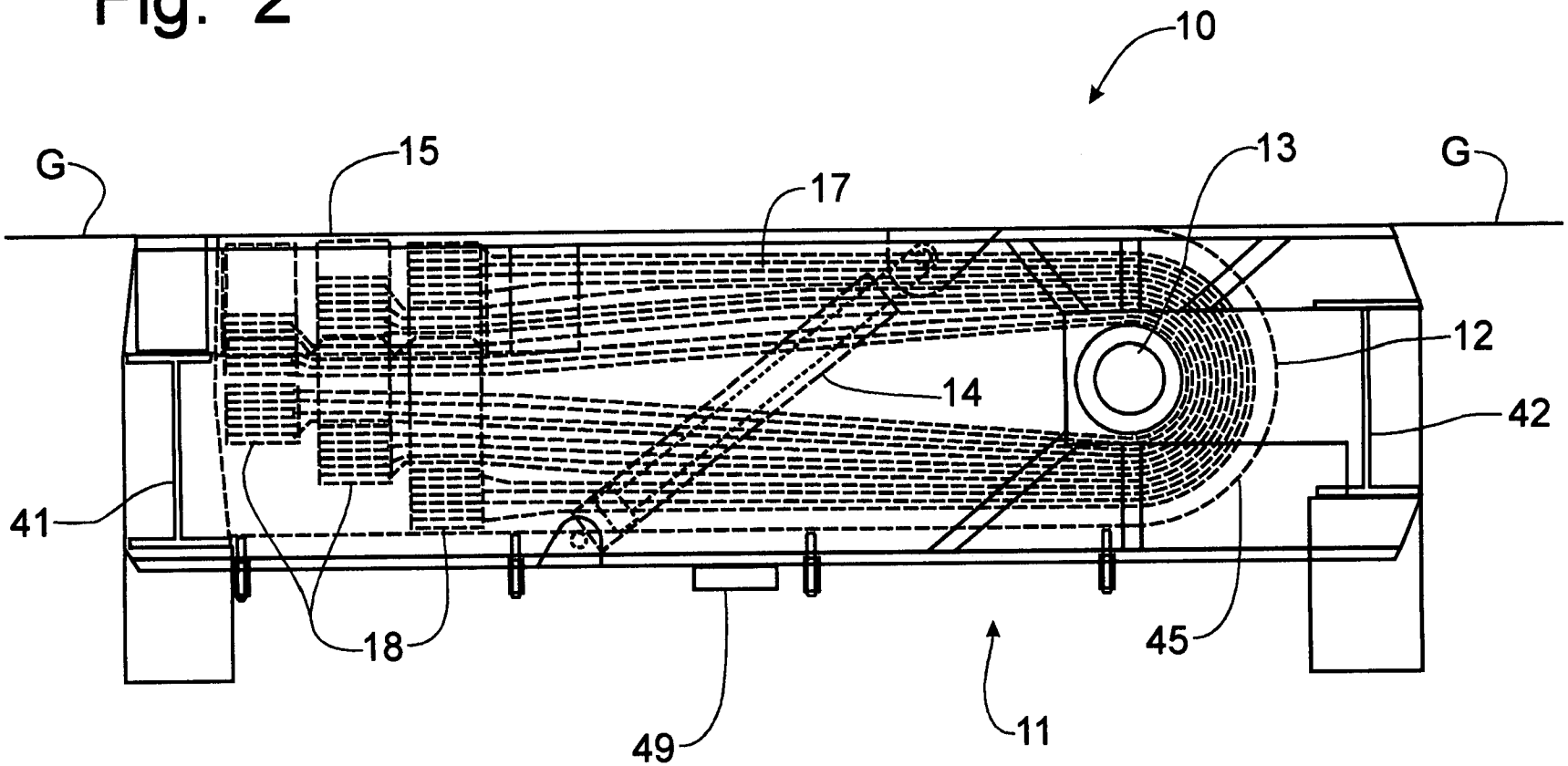
FIG. 2 is a side elevational view of the vehicle security barrier shown in FIG. 1, the concrete support for the apparatus being deleted for purpose of clarity.
Figure 3:
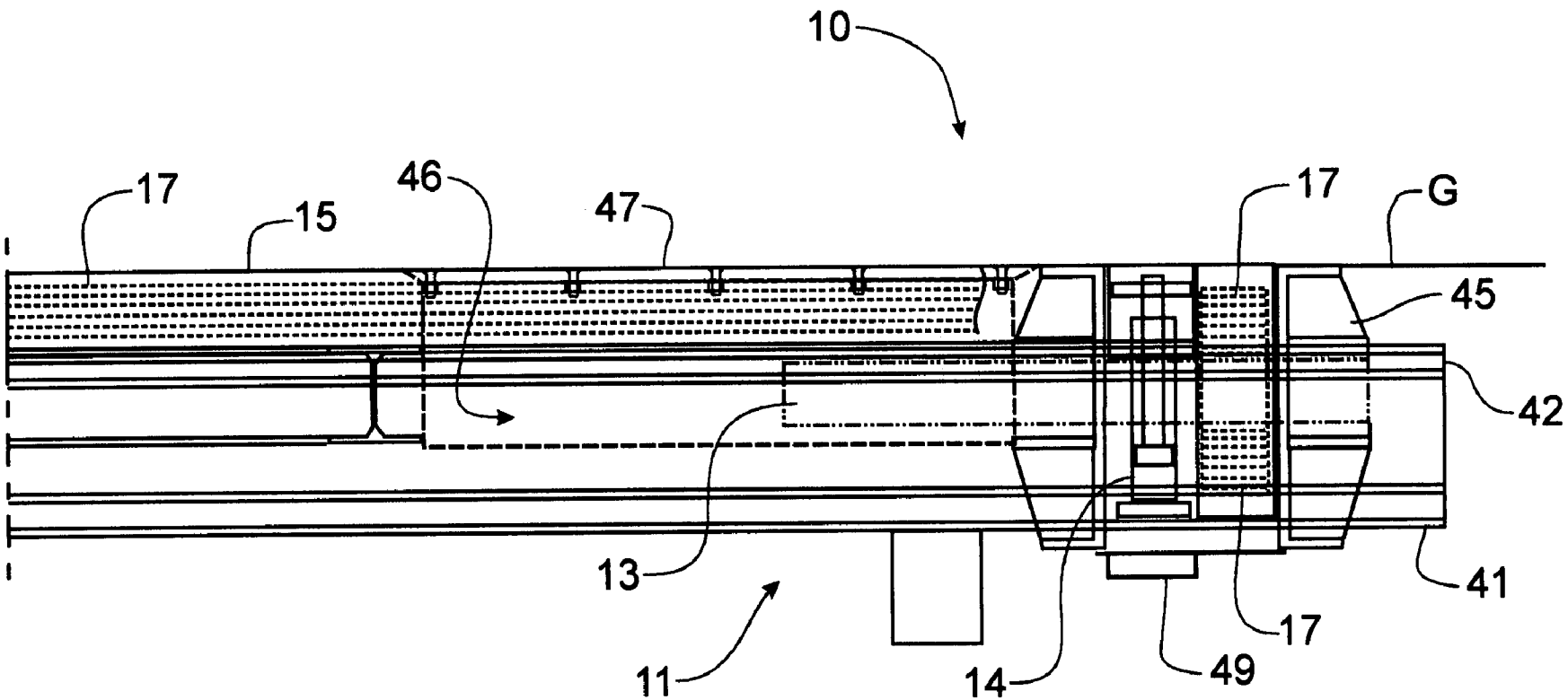
FIG. 3 is a front elevational view of the vehicle security barrier shown in FIGS. 1 and 2, only half of the vehicle security barrier being shown in the drawing with the opposing half being a mirror image.
Figure 4:
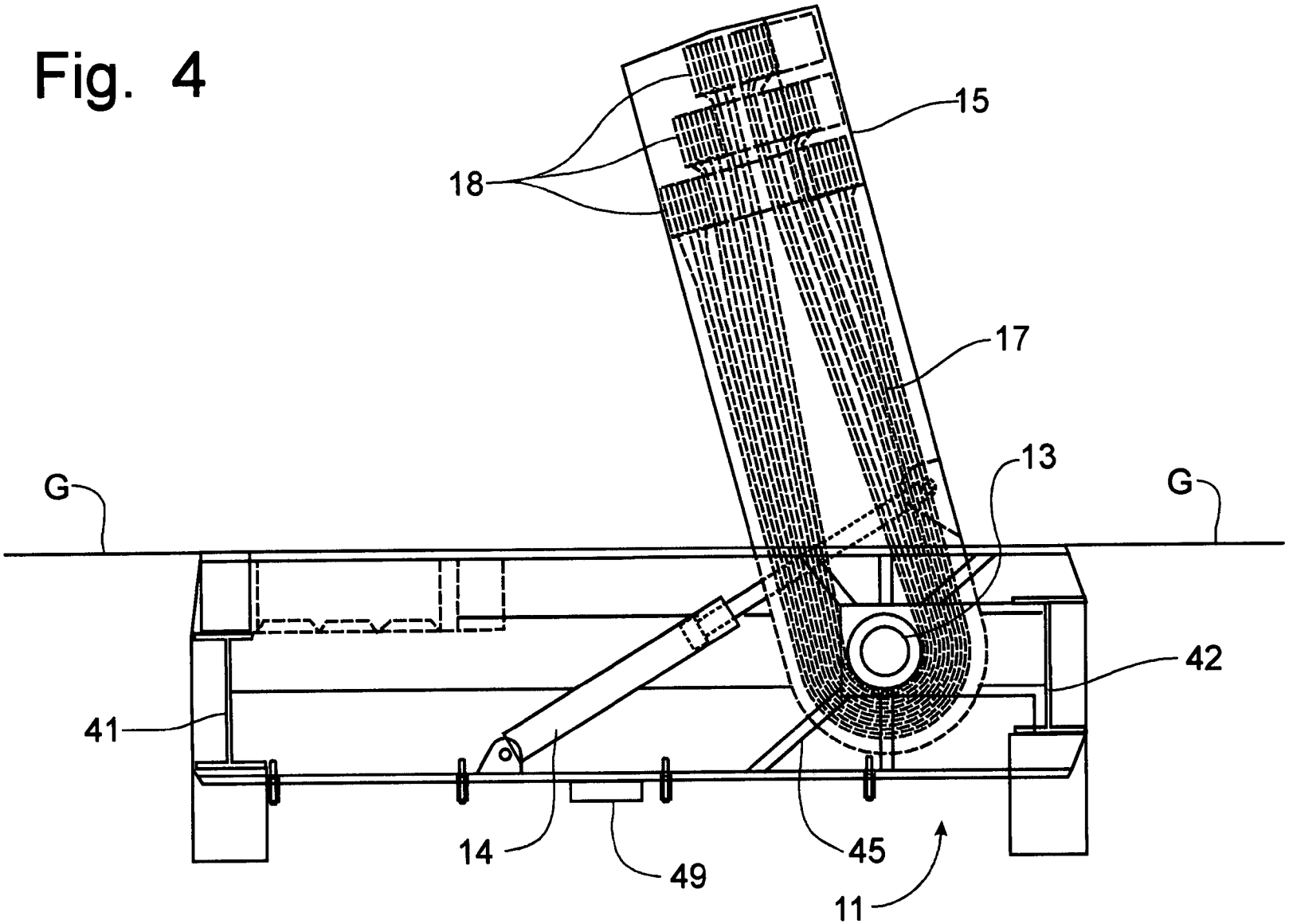
FIG. 4 is a side elevational view of the vehicle security barrier similar to that of FIG. 2, but being oriented into the raised deployed position to prevent the passage of vehicles.
Figure 5:
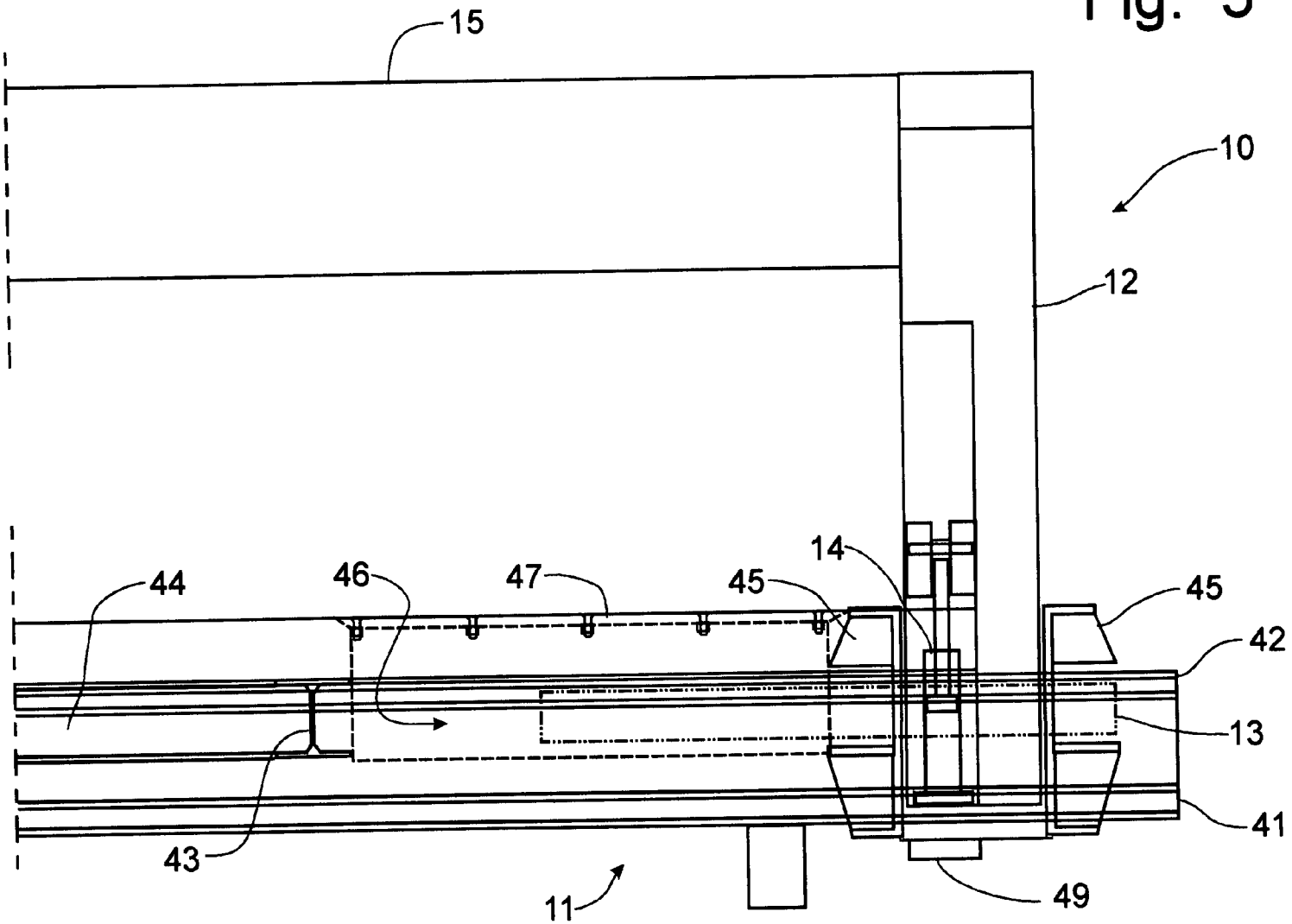
FIG. 5 is a front elevational view of the vehicle security barrier similar to that of FIG. 3, but being oriented into the raised deployed position to prevent the passage of vehicles corresponding to the orientation depicted in FIG. 4.
Figure 6:
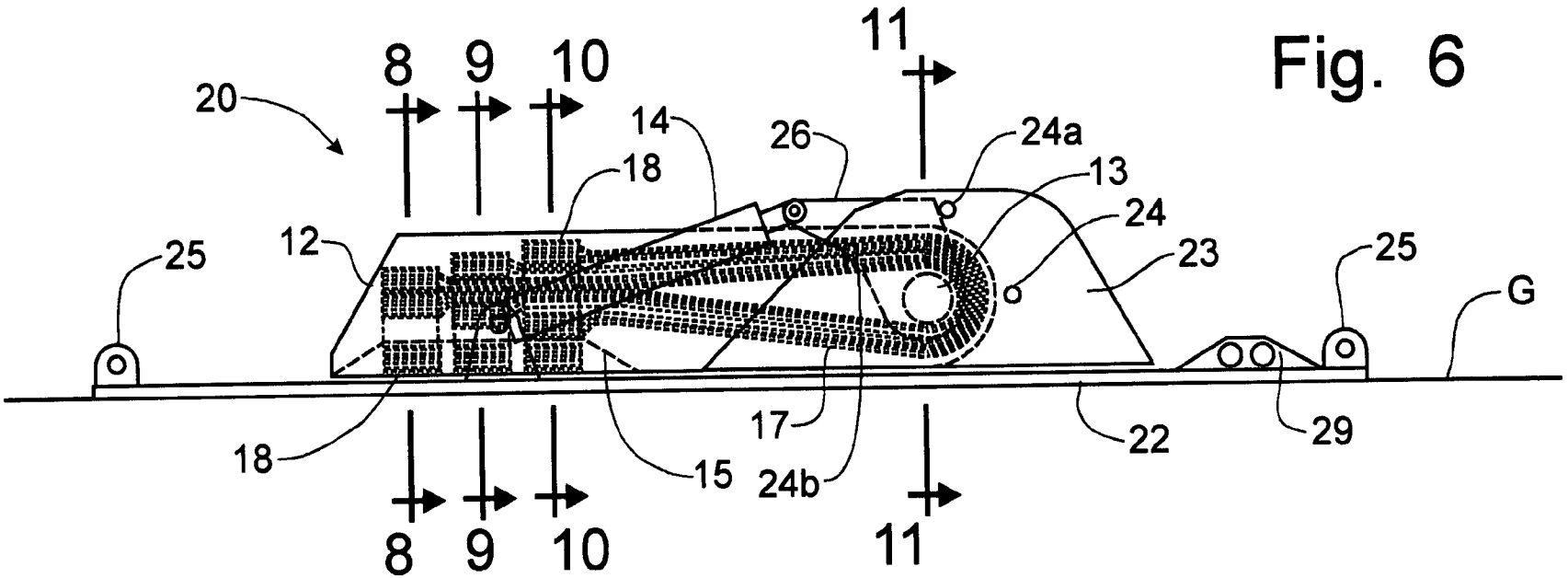
FIG. 6 is a side elevational view of a portable vehicle security barrier incorporating the principles of the instant invention, the barrier being depicted in the lowered or open position to permit the passage of vehicles over the barrier.
Figure 7:
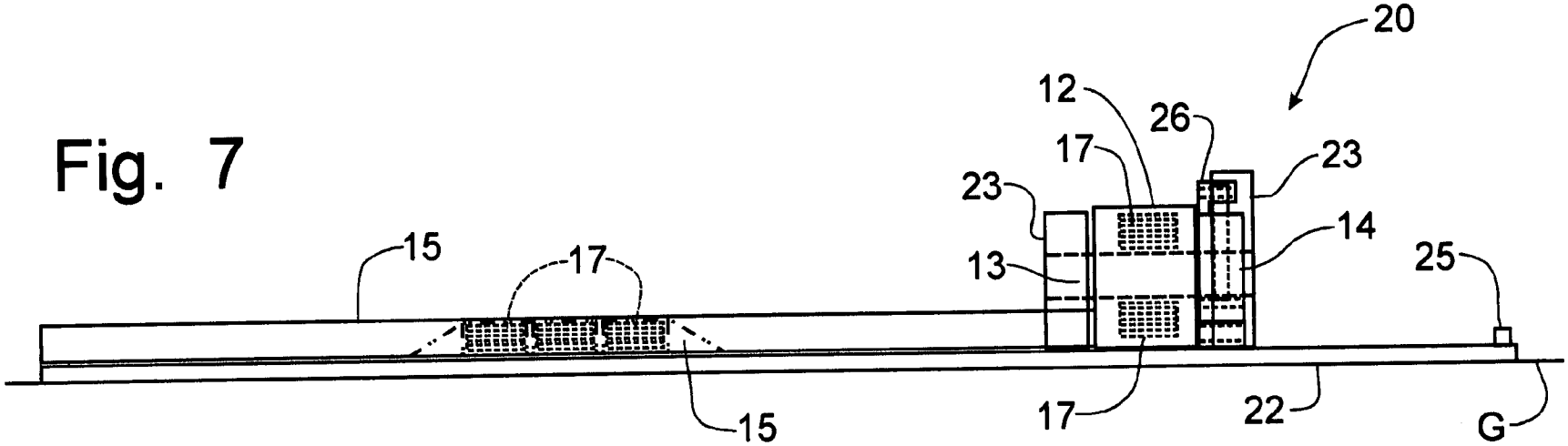
FIG. 7 is a front elevational view of the vehicle security barrier depicted in FIG. 6 with the internal elastic reinforcing bands being depicted in insert cross-sectional images imbedded into the drawing and in the pivot arms for the barrier beam, only half of the vehicle security barrier being shown, the opposing half being a mirror image.
Figure 7A:
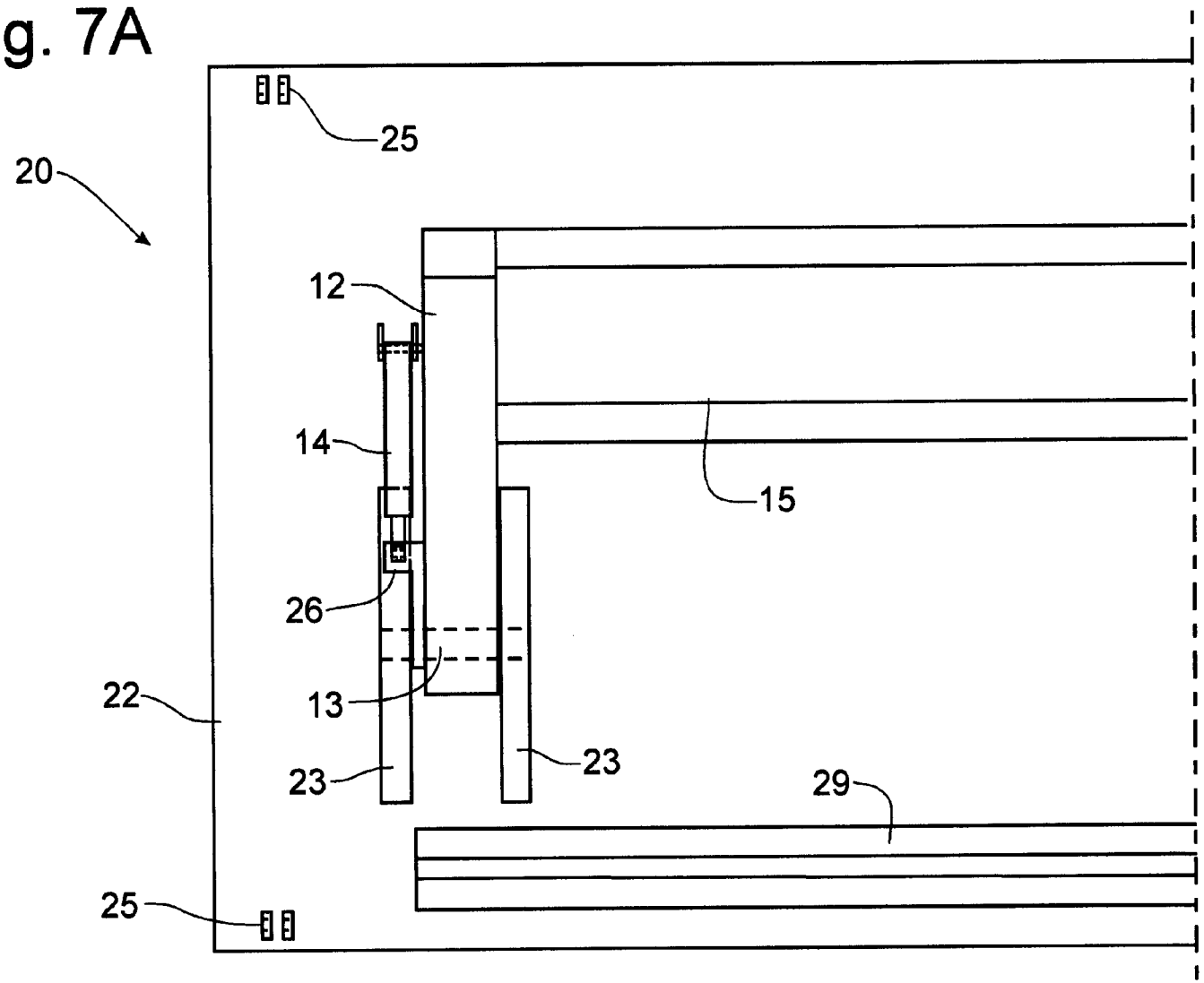
FIG. 7A is a top plan view of the portable vehicle security barrier depicted in FIGS. 6 and 7, only half of the vehicle security barrier being shown, the opposing half being a mirror image.
Figure 9:
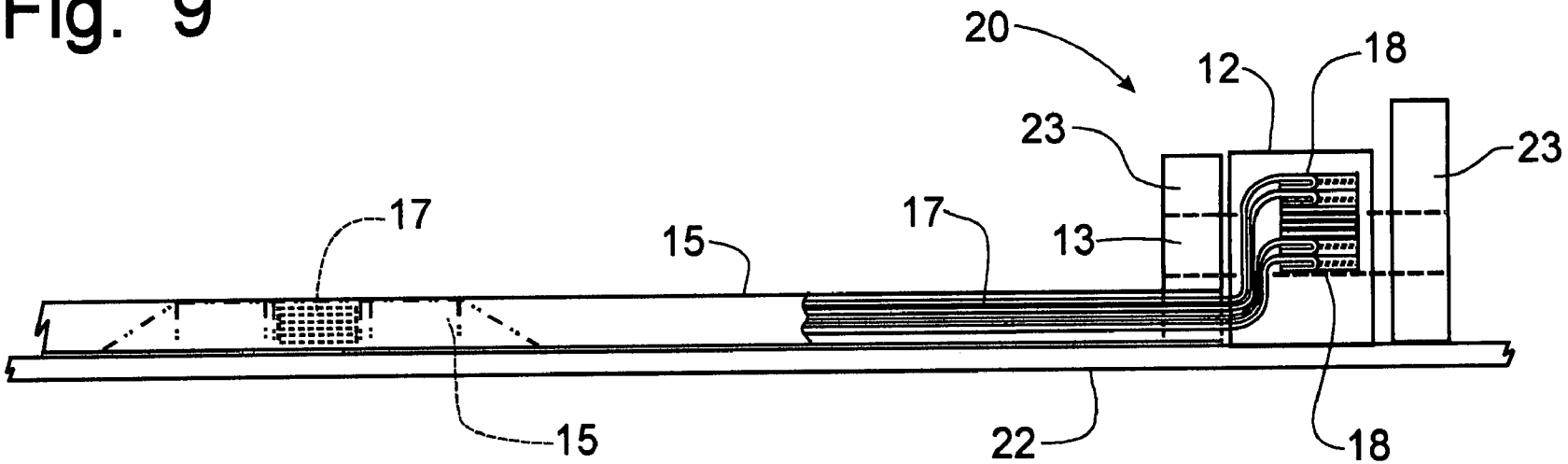
FIG. 9 is a cross-sectional view of the vehicle security barrier corresponding to lines 9--9 of FIG. 7 to depict the passage of the reinforcing bands through the second or middle compartment of the barrier gate, the internal elastic reinforcing bands being depicted in insert cross-sectional image imbedded into the drawing at the barrier gate.
Figure 8:
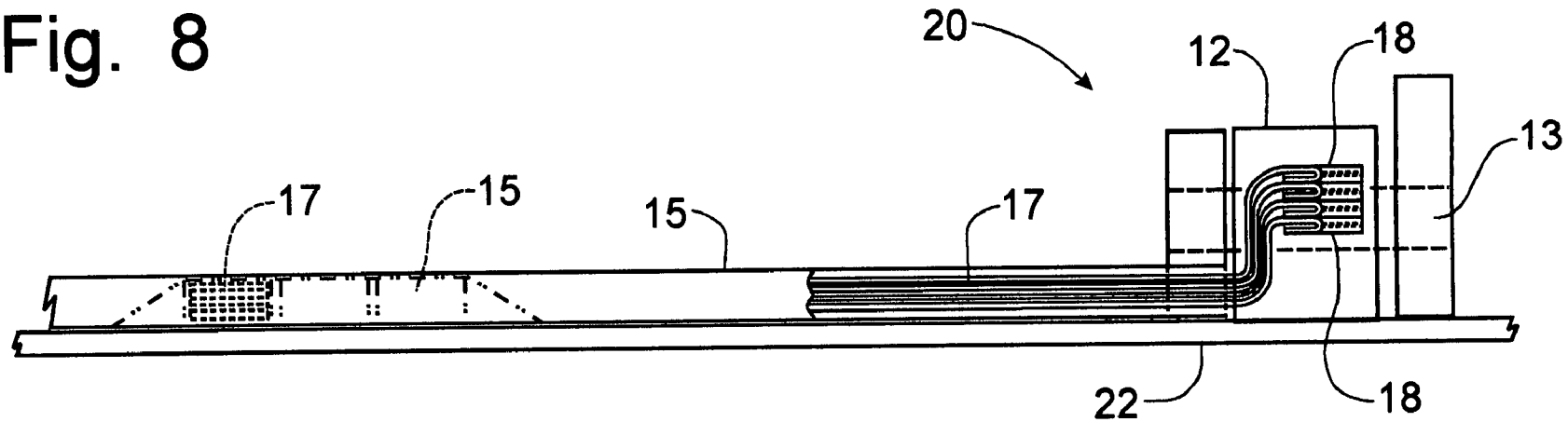
FIG. 8 is a cross-sectional view of the vehicle security barrier corresponding to lines 8--8 of FIG. 7 to depict the passage of the reinforcing bands through the first compartment of the barrier gate, the internal elastic reinforcing bands being depicted in insert cross-sectional image imbedded into the drawing at the barrier gate.
Figure 11:
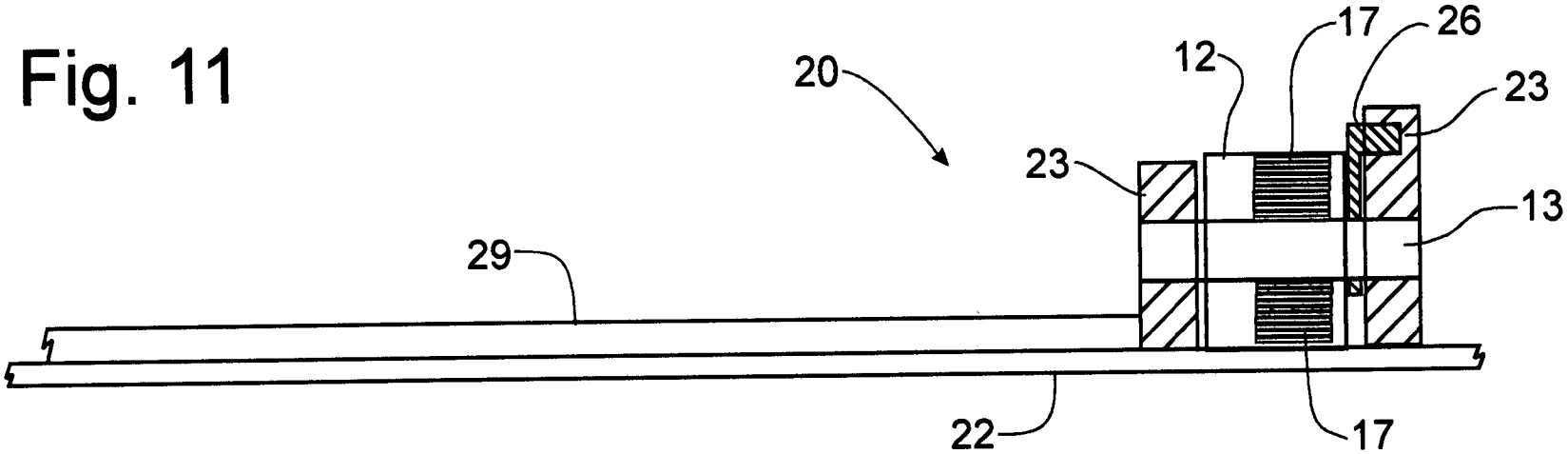
FIG. 11 is a cross-sectional view of the vehicle security barrier corresponding to lines 11--11 of FIG. 7 to depict the wrapping of the reinforcing bands around the pivot pin.
Figure 10:
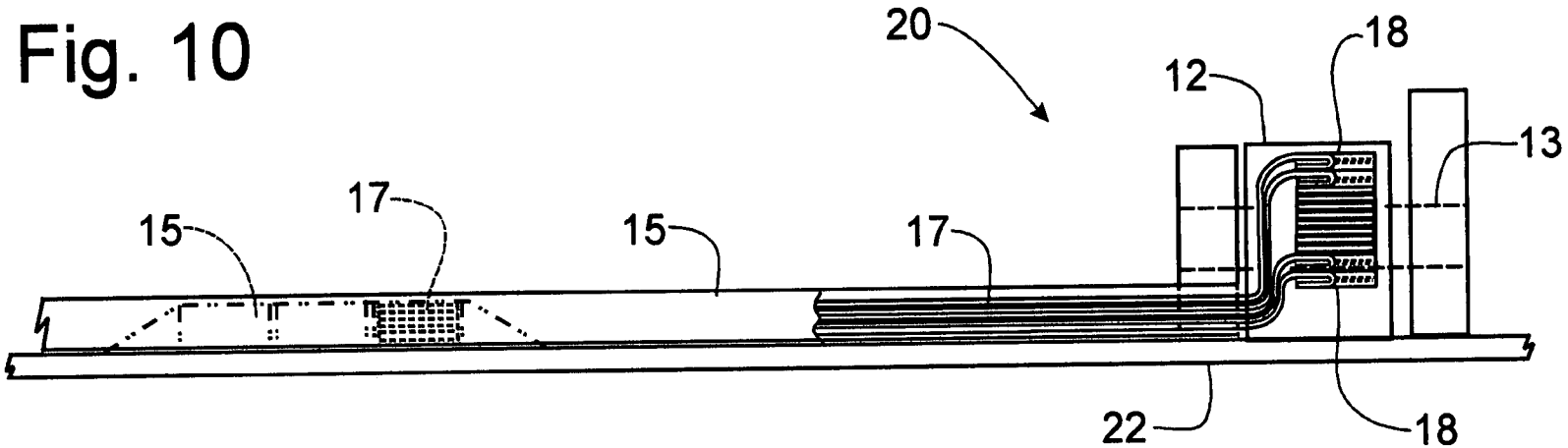
FIG. 10 is a cross-sectional view of the vehicle security barrier corresponding to lines 10--10 of FIG. 7 to depict the passage of the reinforcing bands through the third compartment of the barrier gate, the internal elastic reinforcing bands being depicted in insert cross-sectional image imbedded into the drawing at the barrier gate.
Figure 12:
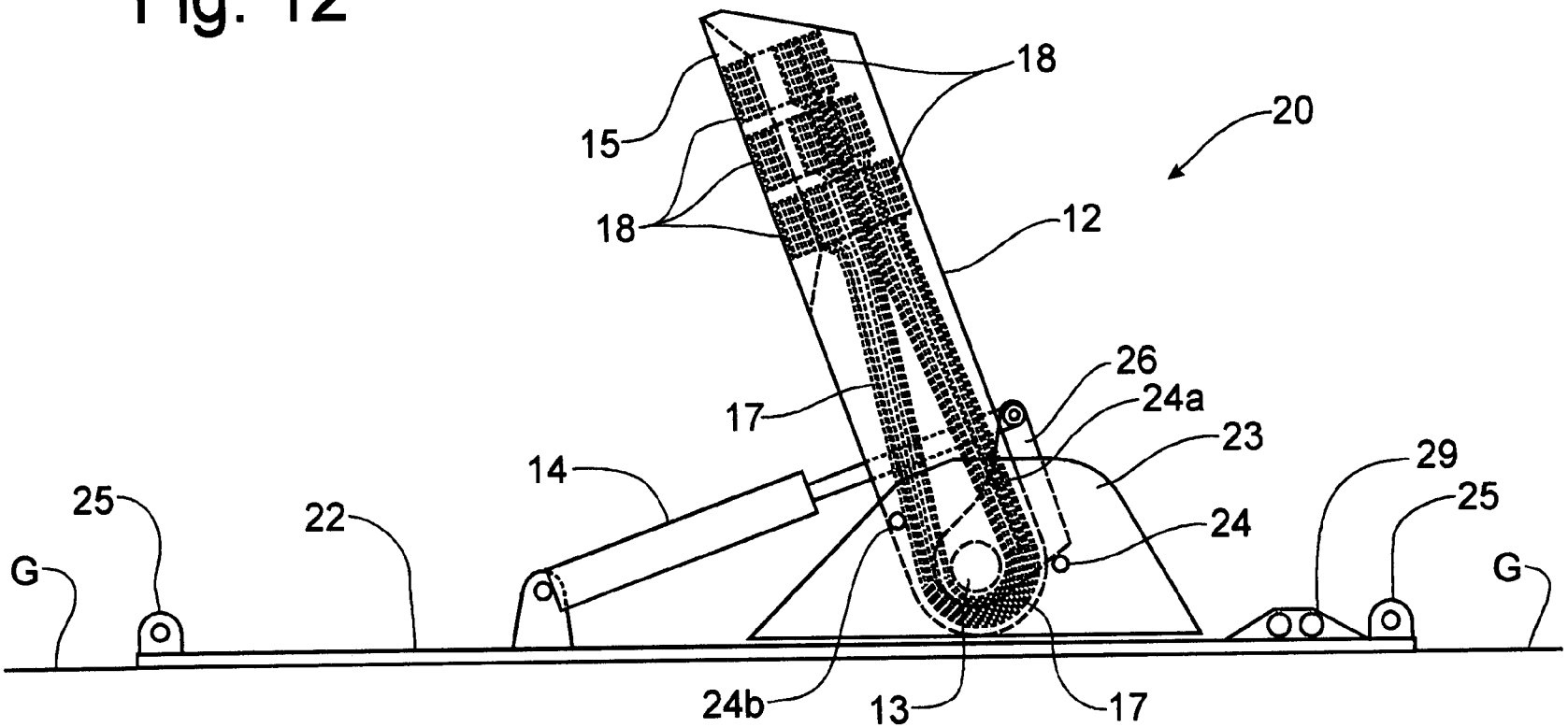
FIG. 12 is a side elevational view of the portable vehicle security barrier similar to that of FIG. 6, but having the barrier gate raised to a deployed position to prevent the passage of vehicles.

As best seen in FIGS. 6 and 12, each of the hydraulic cylinders 14 are connected to a lift link 26 that is affixed to the pivot arm 12 and rotated on the pivot shaft 13 to effect vertical movement of the barrier beam 15 and the pivot arms 12 upon actuation of the hydraulic cylinders 14. The rotation of the lift links 26 are restricted by stops 24, 24*b* carried by the mounting members 23 such that the lift link 26, which is connected to the barrier beam 15 through the pivot arms 12, cannot be rotated beyond a predetermined orientation corresponding to the engagement of the lift links 26 with the stops 24, 24*b*. Accordingly, stop 24 limits the rotation of the barrier beam 15 upwardly, while the stop 24*b* limits rotation of the barrier beam 15 downwardly. The lift links 26 can also be used to lock the barrier 10 into either the raised or lowered positions. When the barrier beam 15 is lowered, the lift link 26 can be restricted from movement by inserting a locking pin (not shown) into the intermediate opening 24*a* in the mounting member 23 to trap the lift link 26 between the locking pin (not shown) in the intermediate opening 24*a* and the stop 24*b* to lock the barrier beam 15 in the lowered open position, or between the locking pin (not shown) and the stop 24 to lock the barrier beam 15 in the raised deployed position, thus preventing movement of the lift link 26 and the attached pivot arm 12.

Referring now to the drawings, but particularly to FIGS. 6-12, the reinforcing bands 17 of the portable barrier 20 are like the reinforcing bands in the permanent barrier 10, which are endless and anchored around the pivot shafts 13 at the opposing transverse sides of the barrier 20. The reinforcing bands 17 are preferably formed as a continuous loop that extends from one pivot shaft 13 at one pivot arm 12 to a corresponding pivot shaft 13 at the opposite pivot arm 12. The bands 17 fold over at right angles at folds 18 within the pivot arm 12 to permit the bands 17 to pass through channels formed in the barrier beam 15. The right angle bends 18 permits the redirection of the band 17 from the barrier beam 15 through the pivot arm 12 to the respective pivot shafts 13. The reinforcing bands 17 can then loop around the pivot shaft 13 to form an anchor for the band 17, though in actual practice the pivot shaft 13 is inserted through the end loop of the band 17. Because of the high stopping power of the reinforcing bands 17, the portable barrier 20 still remains intact and serves as a restraint on the passage of a vehicle when the barrier beam 15 is raised. Although the portable barrier 20 may be laterally displaced upon impact with a vehicle, the barrier 20 will remain intact and prevent the passage of the vehicle over the barrier 20.

A primary advantage of utilizing multiple continuous loop reinforcing bands 17 to resist the impact forces from a vehicle is that the stopping power of the barrier 10 can be varied according to the number and the size of the reinforcing bands 17 used in the manufacture of the barrier 10, 20. If greater stopping power is desired, the number of reinforcing bands can be increased, or alternatively the size and/or thickness of the bands can be increased. The internal routing of the reinforcing bands 17 within the barrier beam and the pivot arms 12 results in an aesthetically pleasing design that can be economically manufactured and transported, as is described in greater detail below.

With conventional vehicle barrier designs, the design becomes much more complex as the barrier increases in width. Conventional barriers are typically designed to block one traffic lane; accordingly they are constructed to be about 12 feet wide. Doubling this length so the barrier can block two lanes of traffic creates substantial design problems for conventional vehicle barriers. For conventional plate-type barriers, the hinge along the bottom that raises and lowers the plate must be so long that alignment of the hinge elements is critical. For conventional beam-type barriers, the beam counterweight must be substantial in order to counterbalance the long beam. For conventional bollard-type barriers, the number of bollards must double, roughly doubling the materials and the cost.

Figure 13:
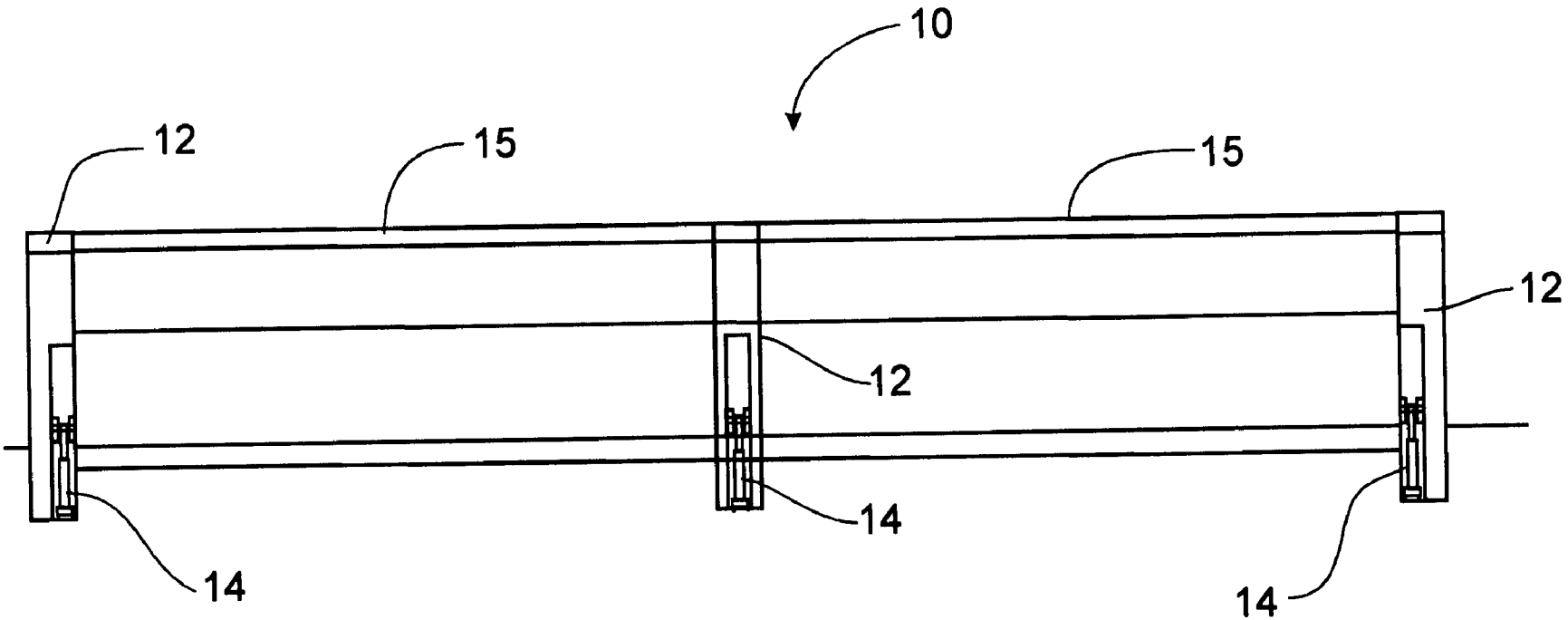
FIG. 13 is a front elevational view of an alternative embodiment of the vehicle security barrier to span across two lanes of roadway with a center support and lifting cylinder being positioned between the two lanes of travel.
Figure 14:
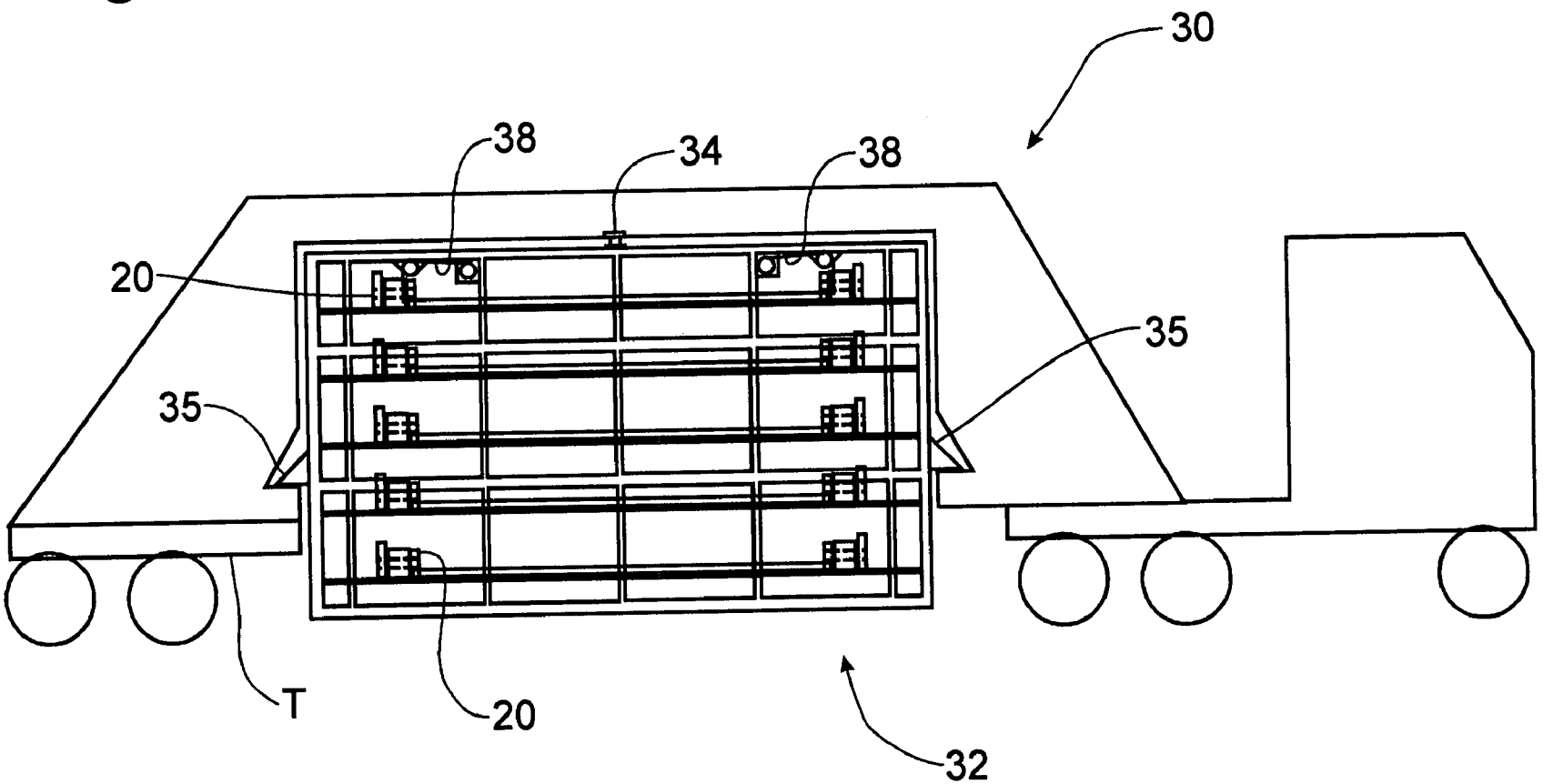
FIG. 14 is a schematic side elevational view of the transporter with the central carrier being rotated into a transport position for movement of the loaded portable vehicle security barriers over the roadway.

For the permanent barrier configuration 10 and the portable barrier configuration 20, the vehicle security barrier 10, 20 can be made to essentially any width without incurring alignment, weight, or similar restrictive problems. To increase barrier width, as is depicted in FIG. 13, the barrier 10, 20 need only provide an intermediate lifting cylinder 14, pivot arm 12, and associated connecting and mounting structure 12, 23. Since the barrier pivot arm 12 is relatively lightweight, the lifting cylinders 14 can also be lightweight and inexpensive. Accordingly, a vehicle security barrier 10, 20 incorporating the principles of the instant invention is very tolerant of flexure as the barrier beam 15 raises and lowers, thus simplifying the design.

Since the portable barrier 20 can be made with lightweight material and still retain adequate stopping power with a low profile structure, the transportation of the barrier 20 is simplified beyond that previously known in the art. When the pivot arm 12 and barrier beam 15 are down, multiple units can be stacked on a trailer. Both permanent (those designed to be imbedded in concrete) and portable versions of this barrier are much simpler to transport. For multiple units sold to a single client, this feature will reduce transportation costs and thereby lower the overall cost of installation.

A transporter 30 for portable vehicle security barriers 20 is shown in FIGS. 14-18. Conventional portable vehicle barrier designs must be trucked one-at-a-time to a site and lowered into position. Some conventional barriers have ancillary wheels so the barrier can be jockeyed into position by a work crew; other portable vehicle barriers require a large forklift to locate them in the desired position. As we noted above, the low profile configuration of the instant invention allows multiple barriers to be stacked for truck transport. The transporter 30 will accomplish the goal of both transporting multiple portable barriers and properly aligning the barriers 20 with the roadway.

Figure 15:
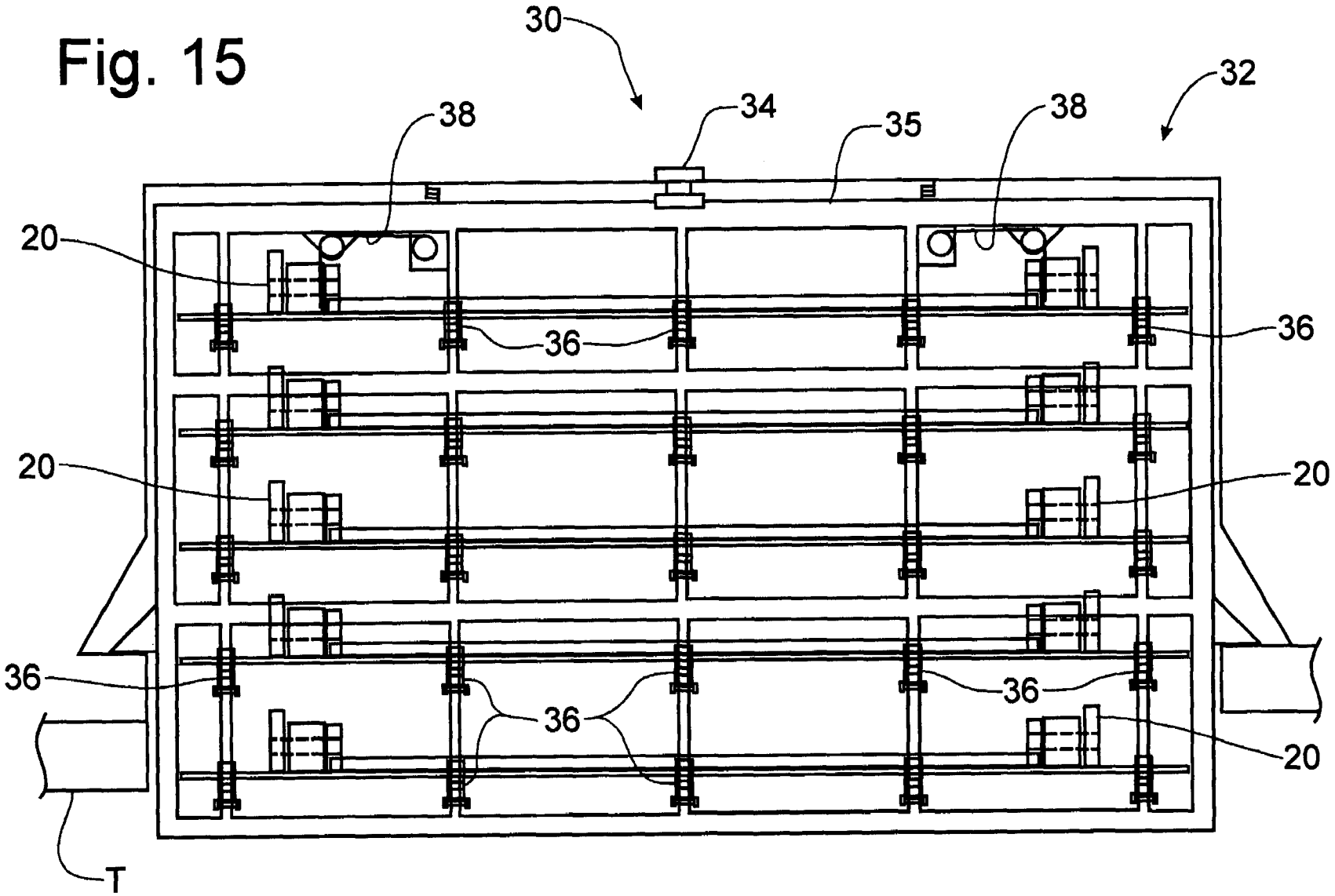
FIG. 15 is an enlarged schematic side elevational view of the central carrier of the transporter depicted in FIG. 14.
Figure 16:
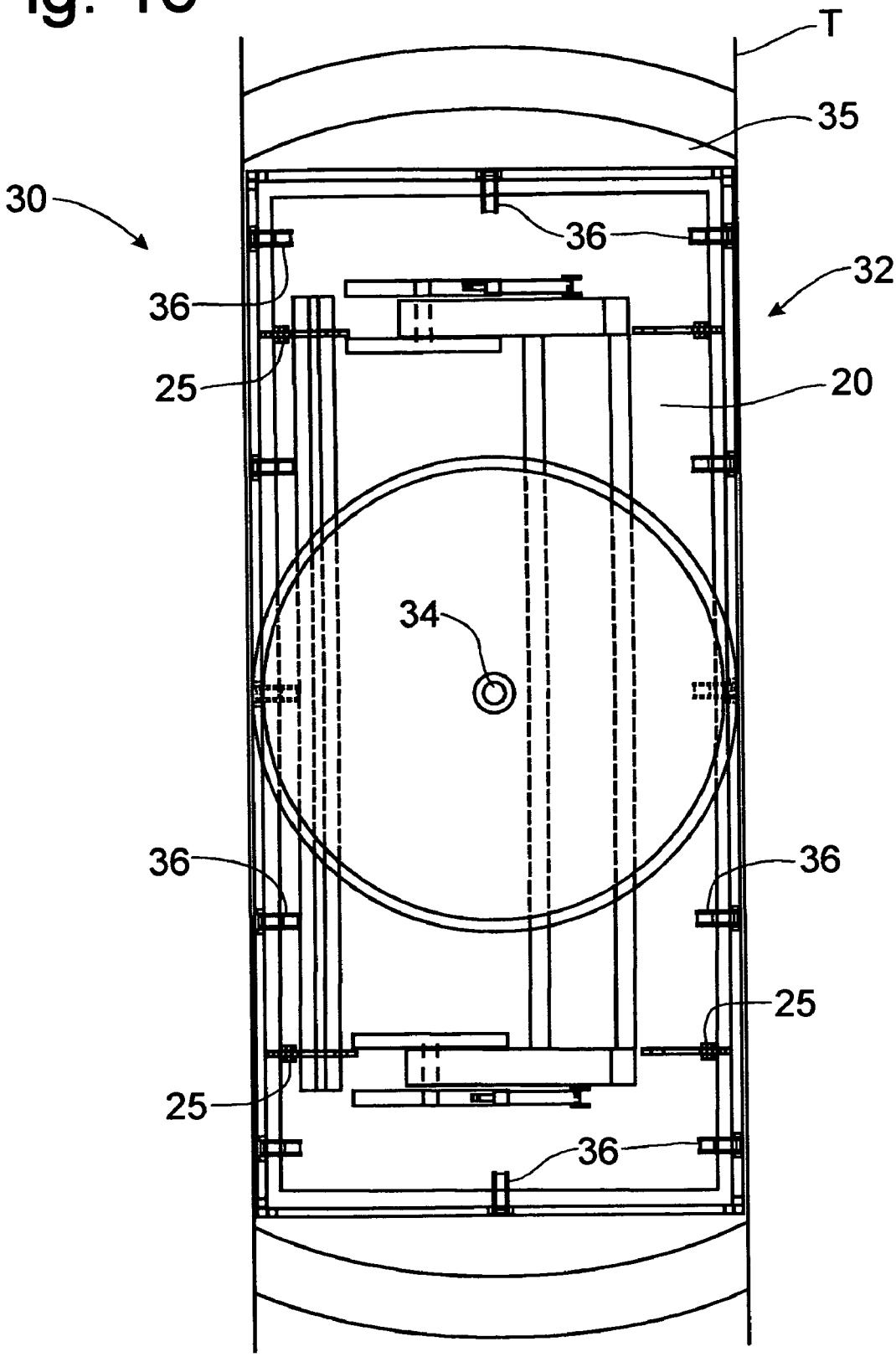
FIG. 16 is a top plan view of the central carrier depicted in FIG. 15.
Figure 17:
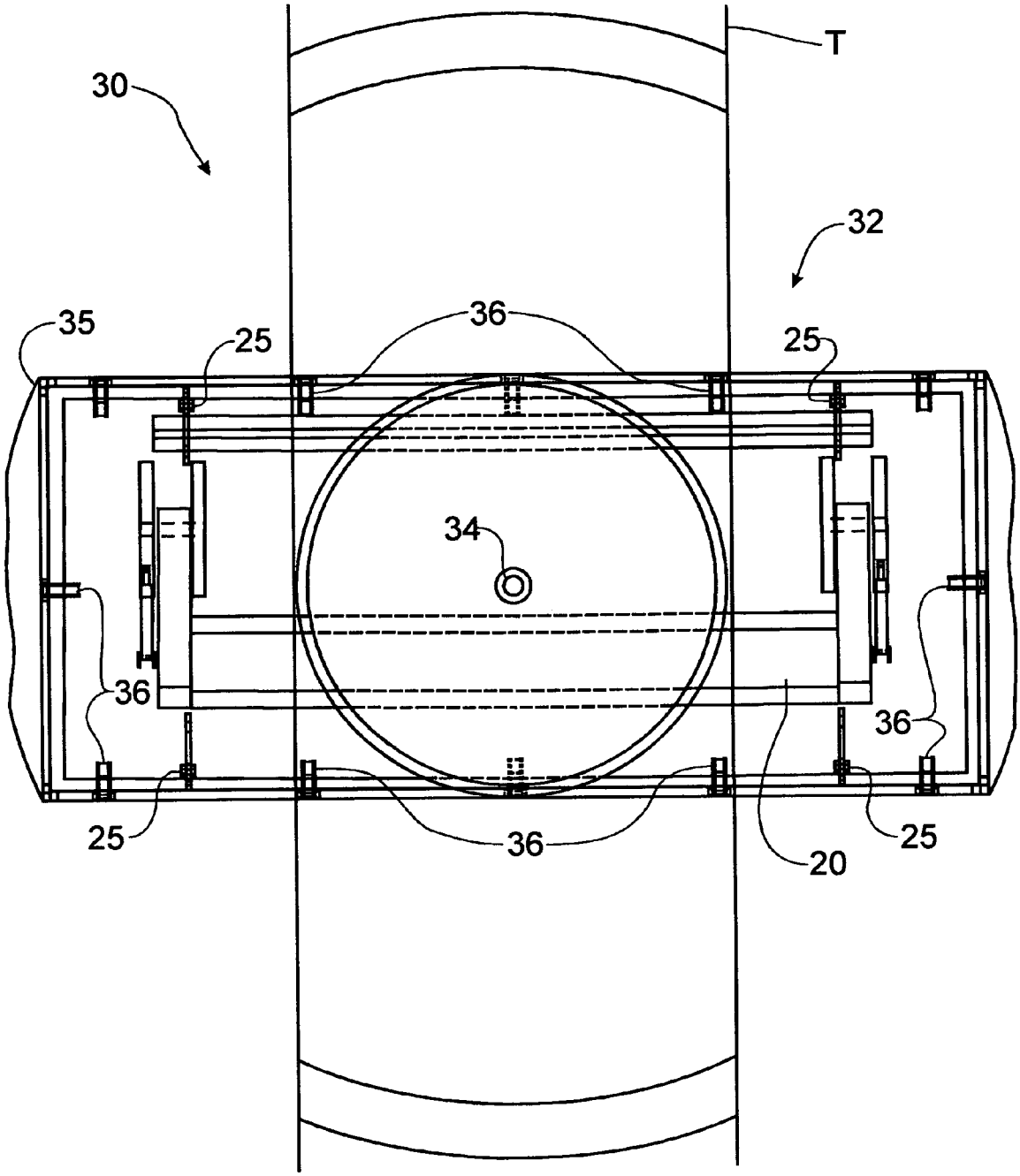
FIG. 17 is a top plan view of the central carrier similar to that of FIG. 15, but having the central carrier rotated for delivery of a portable vehicle security barrier to the roadway surface at the desired location.
Figure 18:
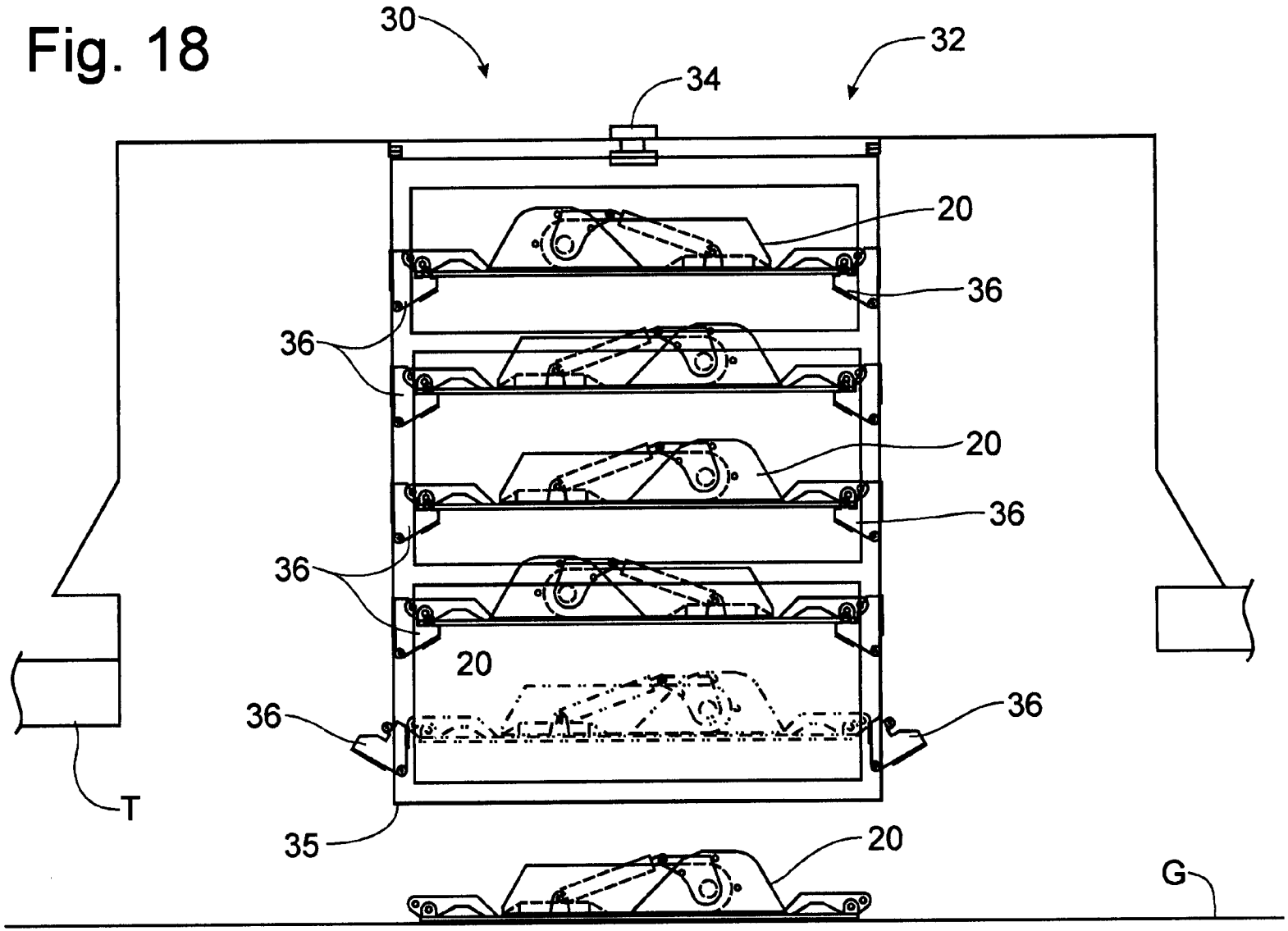
FIG. 18 is a schematic side elevational view of the central carrier as depicted in FIG. 17 with the portable barrier shown on the surface of the ground below the central carrier, the position of the delivered barrier within the central carrier being shown in phantom.

The transporter 30 has a central carrier frame 32 that is supported on a trailer T or other suitable mover. The central carrier 32 is supported on a pivot carriage 35 that is operable to rotate about a vertical pivot axis 34 through an angular rotation of about ninety degrees to either side of a longitudinally oriented transport position, as shown in FIGS. 15 and 16. The central carrier frame 32 is provided with a series of pivoted dogs 36 that are mounted to pivot outwardly when urged from below, but to lock into position when urged from above. The central carrier 32 is also provided with a cable lift system 38 to effect a vertical lifting of the portable barriers 20 into the central carrier 32, as will be described in greater detail below. When the pivot carriage 35 is in the longitudinal transport position depicted in FIGS. 15 and 16, the portable barriers 20 are carried endwise for minimal transport width over the roadway. When the pivot carriage 35 is oriented transversely, as is depicted in FIGS. 17 and 18, the portable barriers 20 are oriented in a normal deployed orientation for placement on the roadway G.

Picking up the barriers 20 is accomplished by positioning the barriers 20 beneath the central carrier 32 and attaching the cable lift system 38 to the lift brackets 25 affixed to the support plate 22. Actuation of the cable lift system 38 affects a raising of the barrier 20 into the central carrier 32. Assuming that a full load of barriers 20 is desired, the cable lift system 38 raises the barrier 20 against the first set of pivoted dogs 36 causing them to pivot outwardly and allow the barrier 20 to pass vertically. When the barrier 20 has reached the desired location above the corresponding dogs 36, the barrier 20 is lowered by the cable lift system 38 into engagement with the dogs 36 which then support the support plate 22, as is depicted in FIGS. 15-17. The process is repeated until the central carrier 32 is filled with portable barriers 20. If the barriers 20 are loaded into the central carrier 32 in an orientation transverse to the direction of travel of the trailer T, the central carrier 32 is rotated to position the barriers 20 endwise for transport. On the other hand, for small distance movement of the barriers 20 without travel over the roadway, the transporter 30 can carry the barriers 20 in an orientation that is transverse to the normal direction of travel to same time and expedite the movement of the barrier 20.

Once transported to the job site, the transporter 30 is positioned over top of the location at which the barrier 20 is to be deployed. The cable lift system 38 is attached to the lowermost barrier 20 and actuated to raise the barrier 20 above the dogs 36, which are then manually pivoted outwardly to permit the vertical passing of the barrier 20. The barrier 20 is then lowered to the ground G without having to be jockeyed into position by a forklift or other positioning device. As is schematically represented in FIG. 18, the transporter 30 is positioned in the desired location. The pivot carriage 35 is rotated in the proper direction to orient the lowermost barrier 20 in the desired orientation. The cable lift system 38 is attached to the lowermost barrier 20 and the corresponding dogs 36 are pivoted outwardly to permit vertical passage of the lowermost barrier 20, which is then lowered to the road surface G. The cable lift system 38 can then be attached to what is now the lowermost barrier 20 to provide a support of the lowermost barrier 20 in addition to the dogs 36 supporting the support plate 22. The carriage 35 can then be rotated back into the transport position and the transporter 30 is then free to move to the next deployment location. As one of ordinary skill in the art will readily recognize, the transporter 30 makes the deployment of portable vehicle barriers 20 faster and easier than has been heretofore known.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A security barrier for selectively preventing the passage of vehicles comprising:

a base support;

a pair of opposing pivot arms pivotally mounted on said base support for pivotal movement about corresponding pivot shafts;

a barrier beam connected to said opposing pivot arms and extending transversely therebetween;

an actuator supported on said base support and connected to at least one of said pivot arms to affect the pivotal movement of said pivot arms about said pivot shafts; and a plurality of reinforcing bands passing internally through said barrier beam and longitudinally through said pivot arms and mounted on an anchor corresponding to each said pivot arm such that said pivot arms are capable of moving vertically to orient said barrier beam from a lowered open position to a raised deployed position while maintaining said reinforcing bands within said pivot arms and said barrier beam.

2. The security barrier of claim 1 wherein said anchors for said reinforcing bands are said pivot shafts.

3. The security barrier of claim 2 wherein said reinforcing bands are endless and looped around both said pivot shafts and extended through said barrier beam, each said reinforcing band being looped around one of said pivot shafts and extending longitudinally thereof toward said barrier beam, each said reinforcing band being oriented in a right angle fold to make a transition from a longitudinal orientation within the respective said pivot arm to a transverse orientation passing through said barrier beam.

4. The security barrier of claim 3 wherein said barrier beam is formed with multiple channels extending transversely therethrough, said reinforcing bands being substantially equally distributed through said channels.

5. The security barrier of claim 3 wherein said barrier beam is attached to at least one intermediate pivot arm and has sufficient transverse length to span multiple travel lanes for the passage of said vehicles.

6. The security barrier of claim 3 wherein each said pivot shaft is supported in a pair of mounting members.

7. The security barrier of claim 6 wherein said mounting members are reinforced hubs affixed to said base support to provide a permanent installation of said barrier.

8. The security barrier of claim 7 wherein said base support is located below ground level, said barrier beam being located at ground level when lowered into said open position.

9. The security barrier of claim 6 wherein said mounting members are affixed to a support plate defining said base support, said support plate being positionable on the surface of the ground.

10. The security barrier of claim 9 wherein said barrier beam has a trapezoidal shape to facilitate the passage of vehicles over said barrier beam when lowered into said open position against said support plate, said barrier further comprising a hose cover mounted on top of said support plate for the passage of hydraulic hoses interconnecting a pair of hydraulic cylinders powering the pivotal movement of said pivot arms.

11. A security barrier for deployment on a roadway surface to prevent in a selective manner the passage of vehicles over said roadway surface, comprising:

a base support;

a pair of opposing pivot arms pivotally mounted on said base support for pivotal movement about corresponding pivot shafts between a lowered inoperative position and a raised deployed position;

a barrier beam connected to said opposing pivot arms and extending transversely therebetween, said pivot arms and said barrier beam being fabricated of lightweight materials which would add little resistance to the passage of vehicles;

a pair of actuators mounted on said base support and connected respectively to said pivot arms to affect the pivotal movement of said pivot arms about said pivot shafts;

mounting members affixed to said base support and being positioned on opposing sides of each said pivot arm to rotatably mount the corresponding said pivot shaft; and a plurality of reinforcing bands passing internally through said barrier beam and longitudinally through said pivot arms and mounted on the respective said pivot shafts such that said pivot arms are capable of moving vertically to orient said barrier beam from a lowered open position to a raised deployed position while maintaining said reinforcing bands within said pivot arms and said barrier beam.

12. The security barrier of claim 11 wherein said barrier beam has a plurality of channels formed therein for the passage of said reinforcing bands through said barrier beam from one pivot arm to the opposing pivot arm.

13. The security barrier of claim 11 wherein said reinforcing bands are endless and looped around said pivot shafts and extend longitudinally therefrom toward said barrier beam, said reinforcing bands being oriented in a right angle fold within each said pivot arm to make a transition from a longitudinal orientation within the respective said pivot arm to a transverse orientation passing through said channels in said barrier beam.

14. The security barrier of claim 13 wherein said base support includes a support plate positionable on said roadway surface.

15. The security barrier of claim 14 wherein said actuators comprise hydraulic cylinders, said security barrier further comprising a hose cover mounted on top of said support plate for the passage of hydraulic hoses interconnecting said actuators to power the pivotal movement of said pivot arms, said hose cover having a trapezoidal shape to facilitate the passage of vehicles over said hose cover.

16. The security barrier of claim 13 wherein said barrier beam is attached to at least one intermediate pivot arm and has sufficient transverse length to span multiple travel lanes for the passage of said vehicles, said intermediate pivot arm being positioned between said travel lanes.

17. The security barrier of claim 13 wherein said base support forms a permanent base located below said roadway, said barrier beam being located at said roadway surface for the passage of vehicles over said barrier beam when said barrier beam is in said lowered inoperative position.

18. A portable security barrier for selective deployment on a roadway surface to be movable between an inoperative position in which vehicles are allowed to pass over said security barrier and a deployed position in which vehicles are prevented from passing over said roadway surface, comprising:

a support plate positionable on said roadway surface;

a pair of mounting members affixed to said support plate on each laterally spaced side of said support plate;

a pivot arm positioned between each respective pair of mounting members, each said pivot arm including a pivot shaft rotatably mounted between said mounting members such that each said pivot arm is generally vertically movable between a lowered inoperative position and a raised deployed position;

a barrier beam connected to said opposing pivot arms and extending transversely therebetween, said barrier beam being fabricated of lightweight materials which would add little resistance to the passage of vehicles;

a pair of hydraulic cylinders mounted on said base support and connected respectively to said pivot arms to affect the pivotal movement of said pivot arms about said pivot shafts between said lowered inoperative position and said raised deployed position; and a plurality of reinforcing bands passing internally through said barrier beam and longitudinally through said pivot arms and mounted on the respective said pivot shafts such that said pivot arms are capable of moving vertically to orient said barrier beam from said inoperative position to said deployed position while maintaining said reinforcing bands within said pivot arms and said barrier beam.

19. The portable security barrier of claim 18 wherein said reinforcing bands are endless and looped around said pivot shafts and extend longitudinally therefrom toward said barrier beam, said reinforcing bands being oriented in a right angle fold within each said pivot arm to make a transition from a longitudinal orientation within the respective said pivot arm to a transverse orientation passing through said channels in said barrier beam.

20. The portable security barrier of claim 13 wherein said barrier beam is attached to at least one intermediate pivot arm and has sufficient transverse length to span multiple travel lanes on said roadway surface for the passage of said vehicles, said intermediate pivot arm being positioned between said travel lanes.

* * * * *